US012628909B2

(12) United States Patent
Lu et al.

(10) Patent No.: US 12,628,909 B2
(45) Date of Patent: May 19, 2026

(54) SOLE STRUCTURE FOR A DECONSTRUCTABLE FOOTWEAR ARTICLE

(71) Applicant: NIKE, Inc., Beaverton, OR (US)

(72) Inventors: Sean Lu, Beaverton, OR (US); Darryl Matthews, Portland, OR (US); William Moroski, Portland, OR (US); Danielle L. Taylor, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/540,527

(22) Filed: Dec. 14, 2023

(65) Prior Publication Data

US 2024/0197036 A1 Jun. 20, 2024

Related U.S. Application Data

(60) Provisional application No. 63/387,655, filed on Dec. 15, 2022.

(51) Int. Cl.

| | |
|---|---|
| ***A43B 13/28*** | (2006.01) |
| ***A43B 13/12*** | (2006.01) |
| ***A43B 13/22*** | (2006.01) |
| ***A43B 21/36*** | (2006.01) |
| ***A43B 23/02*** | (2006.01) |

(52) U.S. Cl.

CPC ..... *A43B 13/28* (2013.01); *A43B 13/125* (2013.01); *A43B 13/223* (2013.01); *A43B 21/36* (2013.01); *A43B 23/0245* (2013.01)

(58) Field of Classification Search

CPC ..... A43B 13/28; A43B 13/125; A43B 13/123; A43B 21/36

See application file for complete search history.

(56) References Cited

U.S. PATENT DOCUMENTS

| | | | | |
|---|---|---|---|---|
| 2,675,631 A * | 4/1954 | Carr | A43B 3/30 36/12 |
| 3,016,631 A | 1/1962 | Servin | |
| 5,012,541 A | 5/1991 | Ganon | |
| 6,311,413 B1 * | 11/2001 | Chern | A43B 13/36 36/137 |

(Continued)

FOREIGN PATENT DOCUMENTS

WO 2020/113316 A1 6/2020

OTHER PUBLICATIONS

International Search Report and Written Opinion received for PCT Patent Application No. PCT/US2023/084393, mailed on Jul. 12, 2024, 21 pages.

(Continued)

*Primary Examiner* — Bao-Thieu L Nguyen
(74) *Attorney, Agent, or Firm* — Shook, Hardy & Bacon L.L.P.

(57) ABSTRACT

This disclosure relates to a sole structure for an article of footwear. Components of the sole structure—e.g., a midsole core, a midsole carrier, and an outsole—may be secured to one another using one or more cables. The sole structure may likewise be secured to other elements of the article of footwear using the one or more cables. Thus, the article of footwear, including the sole structure, may be constructed without the use of an adhesive and may be easily disassembled, improving recyclability.

20 Claims, 14 Drawing Sheets

(56) References Cited

U.S. PATENT DOCUMENTS

| | | | | |
|---|---|---|---|---|
| 6,434,859 | B1 * | 8/2002 | Kim | A43B 7/142 36/43 |
| 7,523,566 | B2 * | 4/2009 | Young-Chul | A43B 13/24 36/28 |
| 7,752,775 | B2 | 7/2010 | Lyden | |
| 7,966,748 | B2 * | 6/2011 | Votolato | A43C 15/02 36/15 |
| 8,776,401 | B2 | 7/2014 | James et al. | |
| 8,839,530 | B2 | 9/2014 | Smith et al. | |
| 8,887,410 | B2 | 11/2014 | Dojan et al. | |
| 9,049,902 | B2 | 6/2015 | Baker et al. | |
| 9,060,567 | B2 * | 6/2015 | Elder | A43B 7/1464 |
| 9,220,318 | B2 | 12/2015 | James et al. | |
| 9,420,850 | B2 | 8/2016 | Dojan et al. | |
| 10,064,448 | B2 | 9/2018 | Langvin et al. | |
| 10,136,701 | B2 | 11/2018 | Klein et al. | |
| 10,251,449 | B2 | 4/2019 | Dojan et al. | |
| 10,258,110 | B2 * | 4/2019 | Sussmann | A43B 13/181 |
| 10,499,709 | B2 | 12/2019 | Pollack et al. | |
| 10,645,990 | B2 | 5/2020 | Rushbrook | |
| 10,881,169 | B2 | 1/2021 | Amis et al. | |
| 11,026,472 | B2 | 6/2021 | Dyer et al. | |
| 11,083,248 | B2 | 8/2021 | Schneider et al. | |
| 11,160,324 | B2 | 11/2021 | Fuerst, Jr. et al. | |
| 11,185,121 | B2 * | 11/2021 | Aveni | A43C 1/06 |
| 11,219,276 | B2 | 1/2022 | Rushbrook et al. | |
| 11,553,759 | B2 * | 1/2023 | Ventenat | A43B 23/042 |
| 11,659,896 | B2 | 5/2023 | Fuerst et al. | |
| 11,666,120 | B2 | 6/2023 | Guest et al. | |
| 2005/0126036 | A1 * | 6/2005 | Wu | A43B 7/08 36/30 R |
| 2005/0268491 | A1 * | 12/2005 | McDonald | A43B 9/00 36/28 |
| 2006/0117600 | A1 | 6/2006 | Greene | |
| 2012/0036740 | A1 * | 2/2012 | Gerber | A43B 13/145 36/134 |
| 2014/0223779 | A1 | 8/2014 | Elder et al. | |
| 2014/0245633 | A1 | 9/2014 | Podhajny | |
| 2014/0325871 | A1 * | 11/2014 | Price | A43B 13/14 36/28 |
| 2015/0013186 | A1 | 1/2015 | Greene | |
| 2016/0206044 | A1 | 7/2016 | Dimoff et al. | |
| 2016/0345656 | A1 * | 12/2016 | Ramirez, II | A63B 21/4043 |
| 2017/0202310 | A1 | 7/2017 | Spanks et al. | |
| 2017/0311672 | A1 | 11/2017 | Hipp et al. | |
| 2019/0014863 | A1 | 1/2019 | Mallios | |
| 2019/0328075 | A1 | 10/2019 | Poulsen et al. | |
| 2019/0365038 | A1 | 12/2019 | Auyang et al. | |
| 2019/0365040 | A1 | 12/2019 | Auyang et al. | |
| 2020/0046078 | A1 | 2/2020 | Durrell et al. | |
| 2020/0077746 | A1 | 3/2020 | Kajiwara | |
| 2020/0138145 | A1 | 5/2020 | Greenspan et al. | |
| 2020/0187595 | A1 | 6/2020 | Siegismund et al. | |
| 2020/0375316 | A1 | 12/2020 | Dealey et al. | |
| 2021/0161242 | A1 * | 6/2021 | Bruce | A43B 13/122 |
| 2021/0204646 | A1 | 7/2021 | Davis et al. | |
| 2022/0039507 | A1 | 2/2022 | Aveni et al. | |
| 2022/0053883 | A1 | 2/2022 | Henrichot et al. | |
| 2022/0322788 | A1 * | 10/2022 | Hardigan, III | A43B 1/0063 |
| 2022/0338597 | A1 * | 10/2022 | Chang | A43B 23/0235 |
| 2023/0225449 | A1 * | 7/2023 | McKenzie | A43B 7/1405 36/12 |
| 2024/0041164 | A1 * | 2/2024 | Kuntz | A43B 13/125 |
| 2024/0197032 | A1 * | 6/2024 | Lu | A43B 13/125 |
| 2024/0197035 | A1 * | 6/2024 | Lu | A43B 23/0245 |

OTHER PUBLICATIONS

Invitation to Pay additional Fee for PCT Patent Application No. PCT/US2023/084393, mailed on Apr. 3, 2024, 14 pages.

Burgess, M., "Adidas's ingenious new way to make shoes? Robotic stirng theory", Gear, Aug. 10, 2020. pp. 1-5.

Eden, S., et al., "How Nike Bulit The Real Power-Lacing Sneaker Of Our Dreams", The Design Issue 2017, Oct. 2016, pp. 1-19.

Sneakerfactory, "Channel stitching a sneaker sole", DIY Sole Stitching—Getting started with the speedy stitcher, Jul. 26, 2021. pp. 1-11.

Non-Final Office Action received for U.S. Appl. No. 18/540,510, mailed on Nov. 27, 2024, 12 pages.

Final Office Action received for U.S. Appl. No. 18/540,510, mailed on Mar. 10, 2025, 7 pages.

Non-Final Office Action received for U.S. Appl. No. 18/540,519, mailed on Feb. 24, 2025, 14 pages.

Final Office Action received for U.S. Appl. No. 18/540,519, mailed on Jul. 1, 2025, 8 pages.

Notice of Allowance received for U.S. Appl. No. 18/540,510, mailed on Aug. 6, 2025, 2 pages.

Notice of Allowance received for U.S. Appl. No. 18/540,510, mailed on Jul. 1, 2025, 7 pages.

* cited by examiner

SOLE STRUCTURE FOR A DECONSTRUCTABLE FOOTWEAR ARTICLE

CROSS-REFERENCE TO RELATED APPLICATIONS

This application claims priority to co-pending U.S. Provisional Application No. 63/387,655, filed Dec. 15, 2022, and titled "Deconstructable Footwear Article," which is incorporated by reference herein in its entirety.

BACKGROUND

A footwear article often includes a sole coupled to an upper, and in many cases, parts of the footwear article can comprise a variety of different types of material. For example, the upper can include one type of material (e.g., polyester (PET), nylon, natural fibers, etc.), whereas the sole can include other, different types of materials (e.g., rubber, ethylene-vinyl acetate (EVA) foam, thermoplastic polyurethane (TPU), etc.). In addition, conventionally a variety of different mechanisms are used to attach one or more components together. For example, the footwear article can include a combination of adhesives (e.g., chemical bonding), mechanical fasteners, stitching, fusion (e.g., thermal bonding), ultrasonic welding, and the like.

In some instances, it can be desirable to deconstruct a footwear article, such as when recycling the footwear article or replacing a component of the footwear article (e.g., replacing a sole or upper or a part thereof). However, conventional construction methods (e.g., attaching parts with various mechanisms) can often make it challenging to deconstruct the footwear article into constituent parts without one material or part being contaminated by, or remaining at least partially affixed to, another material or part. For example, it can be challenging to separate an upper from a sole without at least part of the sole remaining affixed to the upper, and vice versa, since parts of the sole often remain affixed to the upper, including fragments or pieces of the sole that break away and remain affixed to the upper (e.g., based on the adhesive or other attachment mechanism). Similarly, it can be challenging to separate one part of a sole (e.g., midsole including foamed EVA) from another part of the sole (e.g., outsole including rubber or some material other than foamed EVA), without the parts contaminating (e.g., remaining affixed to) one another.

BRIEF DESCRIPTION OF THE DRAWINGS

The present articles, systems, and methods for a deconstructable footwear article are described in detail below with reference to these figures.

DETAILED DESCRIPTION

Figure 1A:
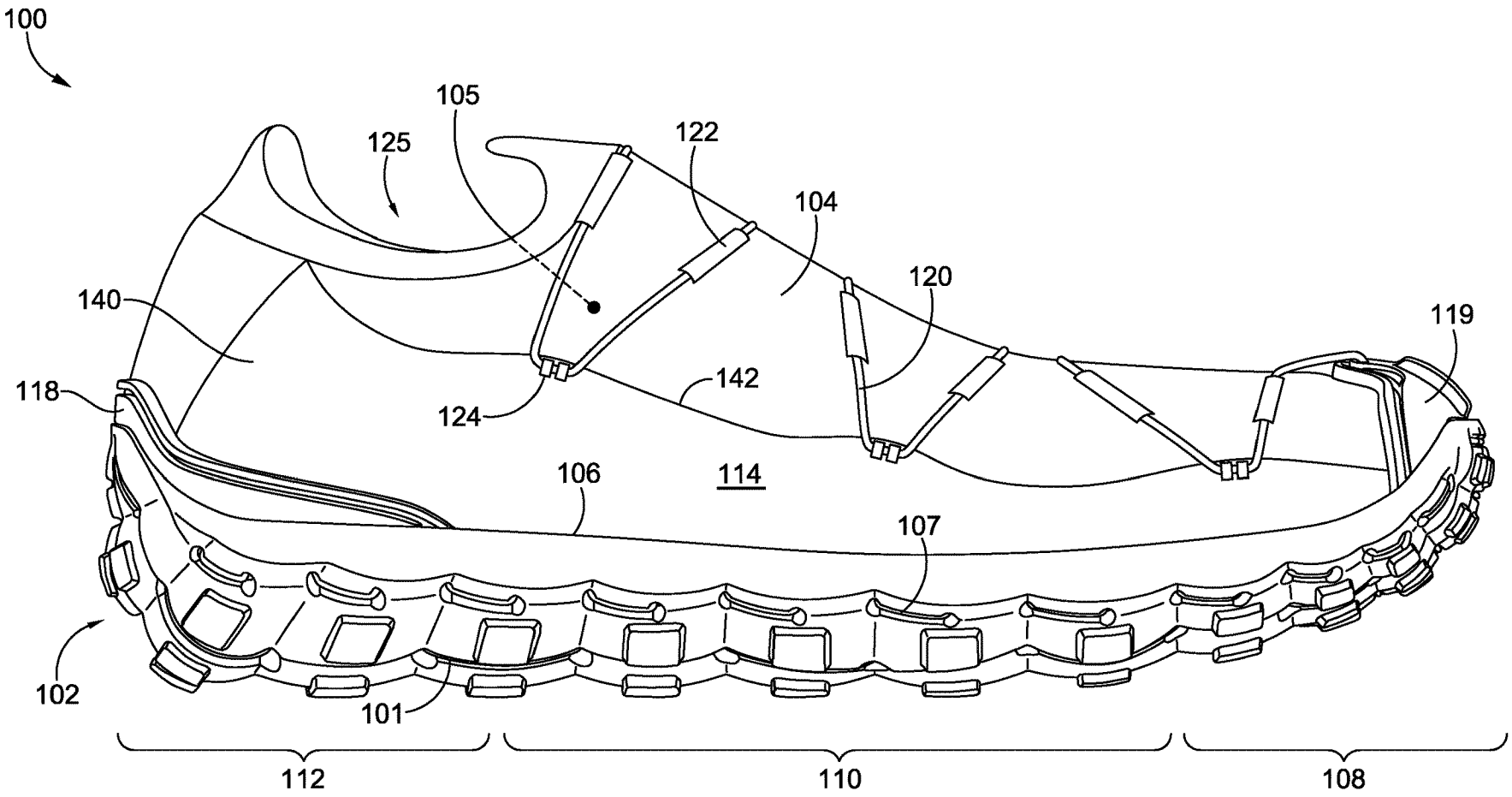
FIG. 1A depicts a lateral side perspective view of an article of footwear, in accordance with examples of this disclosure.

This detailed description is related to a deconstructable footwear article, which includes an upper and a sole having a plurality of parts affixed together by one or more cables. In at least some examples, the upper can be secured, via a cable, to the sole around a perimeter or peripheral edge. For example, the cable can pass through a series of holes or apertures in the sole and through a series of apertures or channels in the upper to affix the parts together. In at least some examples, besides the cable, the upper and the sole can be free (or substantially free) of other, non-cable connections (e.g., chemical adhesives, stitching, fused connections, ultrasonic welding, etc.). As such, in at least some examples, at least a portion of the footwear article can be deconstructed by unthreading (or otherwise removing) the cable. In addition, based on the omission of the non-cable connections, when the footwear article is deconstructed, the parts can be free from contamination from each other (e.g., fragments of one part of the sole do not remain bonded to another part of the sole). As such, in some examples, the parts can be better suited for recycling (e.g., re-pelletizing), since the parts include a more pure form of the constituent material that is not contaminated by the material of other parts. In addition, one or more of the parts can be reused in a subsequent footwear article (e.g., by attaching with the cable or with a new cable).

In contrast to the subject matter of the present disclosure, conventional approaches associated with footwear construction often include attaching footwear components to one another by using chemical adhesives, thermal bonding, stitching, ultrasonic welding, and the like. For example, conventionally, an upper might be affixed to a sole using a chemical adhesive, and similarly, an outsole might be affixed to a midsole by using a chemical adhesive. As such, when these footwear articles are deconstructed, pieces or fragments of one component often remain affixed to another component, which can limit the component's usefulness in subsequent applications. In other examples, conventional solutions might couple components with thermal bonding structures, which can include re-solidified material that was transformed (e.g., with heat) to a softened or molten state and then allowed to capture or encapsulate surrounding structures and re-solidify (e.g., by cooling) to bond to the surrounding structures.

In general, an aspect of this disclosure relates to an article of footwear comprising components affixed to one another via cables. The disclosed article(s) of footwear comprises a variety of features designed to make the article of footwear easier to recycle (e.g., as compared with conventional constructions) while simultaneously maximizing, for example, its stability and the wearer's comfort.

For example, the article of footwear may comprise an upper with a strobel or other portion configured to extend beneath a foot of the wearer. In examples, apertures can be positioned near a perimeter of the strobel and/or in a peripheral margin around the strobel. In at least some examples, the apertures in the upper can align with apertures formed in a sole of the article of footwear—e.g., in a sidewall of the sole—so that the upper may be attached to the sole by threading a cable through the aligned apertures and without the use of an adhesive or other mechanism for connection. In addition, grooves (e.g., on a surface of the sole) can connect apertures associated with the sole and can be configured to contain the cable (e.g., so that portions of the cable exposed on an outer surface of the sole are less susceptible to wear or abrasion). In at least some examples, the sole can also include a plurality of components that are affixed together by use of a cable (e.g., another cable that can connect one or more midsole components and one or more outsole components).

As another example, the strobel can comprise a spacer knit, which can cushion a wearer's foot and can reduce the likelihood of discomfort due to the presence of the cable(s).

As yet another example, the article of footwear may comprise a heel counter and/or a toe cap, which may also be attached to other elements of the article of footwear using one or more cables. Moreover, the heel counter and/or toe cap may receive one or more cables also used to attach other elements of the article of footwear to one another, thus serving as anchor points and improving the article of footwear's stability. For example, in some instances the heel counter and/or toe cap can compositionally comprise a material that is less susceptible to tearing, such as when tension is applied via a threaded cable. As such, the heel counter and/or toe cap can operate to reinforce an anchor point.

In examples of the present disclosure, various features can contribute to the deconstructability of a footwear article. For instance, in at least some examples, a sole of the footwear article can include a midsole carrier component that is configured to support one or more other components of the footwear article. For example, the midsole carrier can include a cavity or recess in a top surface (e.g., similar in some respects to a cup sole) and one or more components can be arranged in the cavity (e.g., drop-in components). For example, the sole can include an outsole component that can be dropped into the cavity of the midsole carrier (e.g., the outsole is arranged on the top of the midsole carrier) and that protrudes through the midsole carrier (e.g., via a through hole) to form a ground-contacting member. In addition, the sole can include a midsole core that can be dropped into the cavity of the midsole carrier, such that the outsole component is layered between the midsole core and the midsole carrier. In examples, a cable can pass through at least the midsole carrier and the midsole core to secure the components together.

In at least some examples, the parts of the sole can include various elements to contribute to the fit and stable connection between the parts. For instance, the midsole carrier can include a through hole configured to receive a traction lug of the outsole component. In at least some examples, the through hole and the traction lug can include a similar shape (e.g., both the through hole and the traction lug can be rectangular). In some examples, the similar shape can include one or more rectilinear portions and/or ovular portions, which can reduce the likelihood of the traction lug rotating relative to the through hole (e.g., when the similar shapes include a similar size and based on the interference between the corresponding rectilinear portions). In addition, the traction lug and the through hole can be similarly sized, such that when the traction lug is inserted into the through hole, the perimeter of the through hold can frictionally engage the traction lug. In some examples, the traction lug can include one more protrusions (e.g., annular rib) that increase the width of the traction lug at certain portions, such that once the traction lug has been inserted in the through hole, the protrusions can impede the traction lug from disengaging from the through hole.

In some examples, the through hole in the midsole carrier can extend from a superior surface of the midsole carrier (e.g., the superior surface facing towards a foot-receiving cavity), through the stratum of the midsole carrier, and to the inferior surface of the midsole carrier (e.g., the inferior surface facing away from the foot-receiving cavity). In addition, the superior surface can include, around the through hole, a concave portion. In at least some examples, the drop-in outsole can include, around the traction lug, a convex portion having a contour that corresponds with the concave portion of the cup-midsole superior surface. As such, when the traction lug is mated with the through hole, the convex portion of the drop-in outsole can nest into the concave portion of the cup-midsole superior surface.

As mentioned, in at least some examples, the midsole core can also be arranged or stacked in the cavity of the midsole carrier and on top of the outsole, such that the outsole is layered between the midsole carrier and the midsole core. In at least some examples, the superior surface of the midsole carrier can include a recess with an outer edge that defines a recess profile or shape. In some instances, the midsole core can include a perimeter, terminal edge that also defines a shape, which corresponds to the recess shape. As such, the midsole core can nest into the recess and atop the outsole. In at least some examples, the various components having corresponding shapes and contours can contribute to an improved fit between the components and a smooth transition from one component to another component. In at least some examples, this can decrease the likelihood that a component might include a protruding edge or other protruding surface in the underfoot portion of the shoe that could cause discomfort (e.g., poking, rubbing, hot spots, etc.).

In examples, the parts of the sole can be affixed to one another using a cable. For example, the parts can include various cable-receiving through holes that received the cable when the cable is threaded among the various parts. In at least some examples, one or more of the parts can include a surface groove that connects a first through hole to a second through hole. As such, when the cable passes or extends along the surface from the first through hole to the second through hole, the cable can be positioned in the groove, which can protect the cable, impede the cable from shifting side to side, and decrease the likelihood that the cable protrudes from the surface and potentially creates discomfort for the wearer. For example, a superior surface of the midsole core (e.g., facing towards the foot-receiving cavity)

can include a cable-retaining surface groove, which can contain a cable, be deep enough to reduce the likelihood of the cable protruding into a footbed of the footwear article, and can impede the cable from sliding around. In some examples, the inferior surface of the midsole carrier (e.g., facing away from the foot-receiving cavity and sometimes facing towards a ground surface when the footwear article is worn) can include a cable-retaining surface groove, which can contain a cable, help protect the cable from the ground surface (e.g., reduce fraying, tearing, breakage, etc.), and can impede the cable from sliding around.

In at least some examples, the footwear article can comprise a variety of different types of material. For example, the upper can include one type of material (e.g., polyester (PET), recycled polyester (rPET), nylon, recycled nylon, natural fibers, etc.), whereas the sole can include other, different types of materials (e.g., rubber, ethylene-vinyl acetate (EVA), thermoplastic polyurethane (TPU), etc.). In addition, in some instances, it can be desirable to deconstruct the footwear article, such as when recycling the footwear article or replacing a component of the footwear article (e.g., replacing a sole or upper or a part thereof). Examples of the present disclosure provide a footwear assembly that is conducive to deconstruction, such that parts of the footwear article comprised of a material are not contaminated by different materials of other parts (e.g., are not contaminated to an extent that renders the part unsuitable for recycling into the material). That is, the use of a cable to affix the various parts also allows for the cable to be unthreaded and removed when deconstruction is desired. When the footwear assembly comprises minimal to no types of non-cable connections (e.g., chemical adhesives, thermal bonding structures, etc.), there is an increased likelihood that portions of one part do not remain affixed or bonded to another part after the deconstruction.

As described, certain aspects of the present disclosure relate to articles of footwear or aspects thereof that are at least partially formed from knit textiles. In an illustrative example, aspects are directed to an upper formed at least partially of a knitted component. As used herein, the term "upper" refers to a footwear component that extends over the instep (e.g., dorsal) and toe areas of the foot, along the medial and lateral sides of the foot, and around the heel area of the foot to form a void for receiving a wearer's foot. Illustrative, non-limiting examples of uppers may include uppers incorporated into a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. Further, in other aspects, the upper may also be incorporated into a non-athletic shoe, such as a dress shoe, a loafer, and a sandal. Accordingly, the concepts disclosed with respect to articles of footwear apply to a wide variety of footwear types. Although the figures may illustrate an article of footwear intended for use on only one foot (e.g., a left foot) of a wearer, one skilled in the art will recognize that a corresponding article of footwear for the other foot (e.g., a right foot) would be a mirror image of the right article of footwear.

Positional terms used when describing articles of footwear or aspects thereof, such as top, bottom, front, sides, back, superior, inferior, lateral, medial, right, left, interior, exterior, interior-facing, exterior-facing, and the like, are used with respect to the article of footwear or upper being worn as intended with the wearer standing upright such that the wearer's foot is in the foot-receiving void and the wearer's ankle or leg extends through the ankle opening. For example, an "upwardly-facing surface" and/or an "upper surface" of an upper refers to the surface oriented in the "superior" anatomical direction (i.e., toward the head of a wearer) when the article of footwear is being worn by the wearer. Similarly, the directional terms "downwardly" and/or "lower" refer to the anatomical direction "inferior" (i.e., toward the ground and away from the head of the wearer). "Front" or "forward" means "anterior" (e.g., toward the toes), and "rear" means "posterior" (e.g., toward the heel). "Medial" means "toward the midline of the body," and "lateral" means "away from the midline of the body." "Longitudinal axis" refers to a centerline of the article extending between the heel region and the forefoot region. Similarly, a "longitudinal length" refers to a length of the article along the longitudinal axis, and a "longitudinal direction" refers to a direction along the longitudinal axis. It should be understood, however, that use of positional terms does not depend on the actual presence of a human being for interpretative purposes.

The term "knitted component" refers to a textile piece that is formed from at least one yarn that is manipulated (e.g., with a knitting machine) to form a plurality of intermeshed loops that define courses and wales. The term "course," as used herein, refers to a predominantly horizontal row of knit loops (in an upright textile as it is knit on the knitting machine) that is produced by adjacent needles during the same knitting cycle. The course may comprise one or more stitch types, such as a knit stitch, a missed stitch, a tuck stitch, a transfer stitch, a rib stitch, and the like, as these terms are known in the art of knitting. The term "wale," as used herein, is a predominantly vertical column of intermeshed or interlooped knit loops, generally produced by the same needle at successive (but not necessarily all) courses or knitting cycles.

The term "integrally knit," as used herein, may mean a knitted component having a yarn from one or more knitted courses in a first area or region being interlooped with one or more knitted courses of another area or region. The interlooping may be through a simple knit stitch, a tuck stitch, a held stitch, a float or miss stitch, and the like. In this way, areas that are integrally knit together have a seamless transition.

As used herein, the term "perimeter" refers to an area forming the boundary of the object referred to. For example, a perimeter of a knitted component is the area that extends along the boundary of that structure. The "outer perimeter" may refer to portions of a perimeter of a knitted component that, once formed into an article of footwear, are secured to the sole structure or form a seam between two ends of the outer perimeter (such that they may at least partially extend under the foot of the wearer when the article of footwear is worn. In contrast, an "inner perimeter" may refer to portions of the perimeter of a knitted component that, once formed into an article of footwear, define openings, such as an opening in a throat region and/or the ankle opening. The perimeter (outer perimeter or inner perimeter) may refer to an edge of the knitted component or to a peripheral area adjacent the edge.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional assembly. Additionally, there are various measurements provided herein. Unless indicated otherwise, the term "about" or "substantially" with respect to a measurement means within ±10% of the indicated value.

Example Articles of Footwear

Figure 1B:
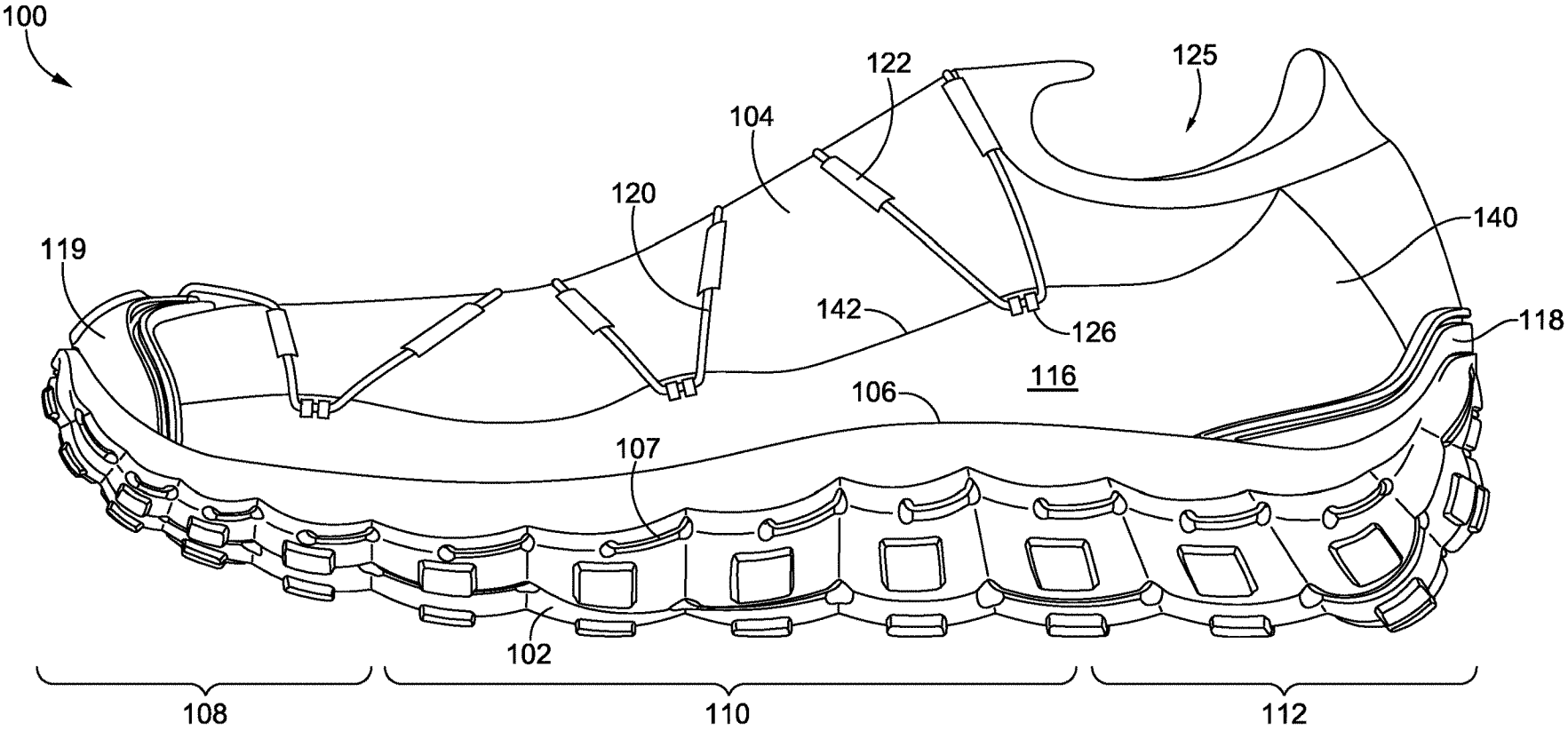
FIG. 1B depicts a medial side view of the article of footwear of FIG. 1A, in accordance with examples of this disclosure.

FIGS. 1A and 1B depict a lateral side view and a medial side view, respectively, of an article of footwear 100 and its components, according to examples of the present disclosure. The article of footwear 100 comprises a sole structure 102 and an upper 104. The upper 104 is coupled to and extends from the sole structure 102, and in some examples, the upper 104 can at least partially enclose a foot-receiving cavity 105 (e.g., FIG. 2B) or space. The area of the article of footwear 100 where a topline edge 106 of the sole 102 aligns with the upper 104 may be referred to as the biteline. In at least some examples of the present disclosure, the upper 104 may be joined to the sole structure 102 by a cable 107 (e.g., a peripheral cable that at least partially extends around a periphery of the article of footwear 100), as discussed in more detail below. In addition, parts of the sole 102 can be coupled together via a cable 101 (e.g., an underfoot cable that is threaded through various apertures in the midsole and/or outsole components). In addition to attaching the sole 102 to the upper 104, in some examples, the cable 101 and/or the cable 107 can couple a heel counter 118 and a toe cap 119.

The cables 101 and 107 may be at least partially nested into a groove or recess, and as such, are partially obscured from view in FIG. 1A. The one or more cables may include various types of cables, such as a braided cable, and can have various properties (e.g., diameter, compositional material, filament count, etc.). For example, the cables 101 and 107 can include a diameter in a range of about 1.0 mm to about 1.4 mm. In addition, the cables 101 and 107 can include a filament count of about 96 filaments. Further, the one or more cables may comprise polyester, such as recycled polyester, or other high-tenacity materials. In at least some examples, components of the article of footwear 100 can be coupled together via the cables 101 and 107 and without (or substantially without) at least some other forms of connections (e.g., chemical adhesives, thermal bonding, stitches, etc.).

The article of footwear 100 (and/or its components) can be divided into one or more regions (which can also be referred to as "areas" or "portions"). For example, in an anterior-to-posterior direction, the article of footwear 100 (and/or its components) can be divided into (and/or include) a forefoot region 108, a midfoot region 110, and a heel region 112. The forefoot region 108 of the article of footwear 100 can correspond to anterior portions of a foot, including toes and joints connecting metatarsal bones with phalanx bones of the foot. The midfoot region 110 of the article of footwear 100 can correspond with an arch area of the foot. The heel region 112 of the article of footwear 100 can correspond with posterior portions of the foot, including a calcaneus bone. In a medial-to-lateral direction, the article of footwear 100 (and/or its components) can be divided into a lateral side 114 (e.g., FIG. 1A) and a medial side 116 (e.g., FIG. 1B), both of which extend through the forefoot region 108, the midfoot region 110, and the heel region 112. More particularly, the lateral side 114 corresponds with an outside area of the foot (i.e., the side that faces away from the other foot) when the article of footwear 100 is worn, while the medial side 116 corresponds with an inside area of the foot (i.e., the side that faces towards the other foot) when the article of footwear 100 is worn. Additionally, a footbed of the article of footwear 100 may correspond to an area underneath the foot when the article of footwear 100 is worn. These regions, sides, and areas (e.g., 108, 110, 112, 114, 116, etc.) are not intended to demarcate precise areas of the article of footwear 100 but, rather, are intended to represent general areas of the article of footwear 100 to aid in understanding the various descriptions provided herein.

The sole structure 102 generally extends between the foot and the ground when the article of footwear 100 is worn. The sole structure 102 may include multiple components, such as an outsole and a midsole. Various materials may be used to form the sole structure 102, such as rubber, ethylene-vinyl acetate (EVA) foam or phylon, thermoplastic polyurethane (TPU), thermoplastic elastomer (e.g., polyether block amide), and the like. The sole structure 102 may include various other features to attenuate forces, enhance stability, and/or provide traction, such as treads, as understood by one skilled in the art.

The upper 104 defines a foot-receiving cavity 105 (e.g., FIG. 2B) within the article of footwear 100 for receiving and securing a foot relative to the sole structure 102. Access to the foot-receiving cavity 105 is provided by an ankle opening 125 (e.g., FIGS. 1A and 2B) located in at least the heel region 112. In at least some examples, the upper 104 can include a portion 202 (e.g., FIG. 2B), such as a strobel, extending from the medial side of the upper to the lateral side of the upper and across a top or superior side of the sole 102, and this portion can form at least part of a floor or the footbed beneath the foot-receiving cavity 105. In some examples, this portion may be referred to as an "underfoot portion" or "underfoot region."

The article of footwear 100 can also include a closure system to adjust a size or fit associated with the foot-receiving cavity 105. In this manner, the closure system can be used, for example, to secure and/or release the article of footwear 100 to and/or from a wearer's foot. In FIGS. 1A and 1B the closure system includes a cable 120 that is threaded among various tubular encasements 122 and anchor points 124 and 126 (e.g., lateral-side anchor points 124 in FIG. 1A and FIG. 2B and medial-side anchor points 126 in FIG. 1B and FIG. 2B). In some examples, the closure system can be referred to as a lacing system. The closure system can also (or alternatively) include laces, straps, bands, cords, ratcheting mechanisms, hook-and-loop, etc.

Example Uppers for Articles of Footwear

As indicated, the footwear article 100 can include an upper 104. At least some portions of upper 104 can be constructed from one or more different types of textiles, such as knit, woven, nonwoven, extruded film, braided, and the like. In examples, at least a portion of the upper 104 can include at least one knitted component formed by a knitting process, such as by a weft-knitting process on a flat knitting machine, for example. In some aspects, the entire or substantially the entire upper 104 may be formed of the knitted component. In some examples, multiple parts of an upper can be separately formed (e.g., knit, woven, entangled, etc.) and later affixed to one another to form the upper.

Figure 3B:
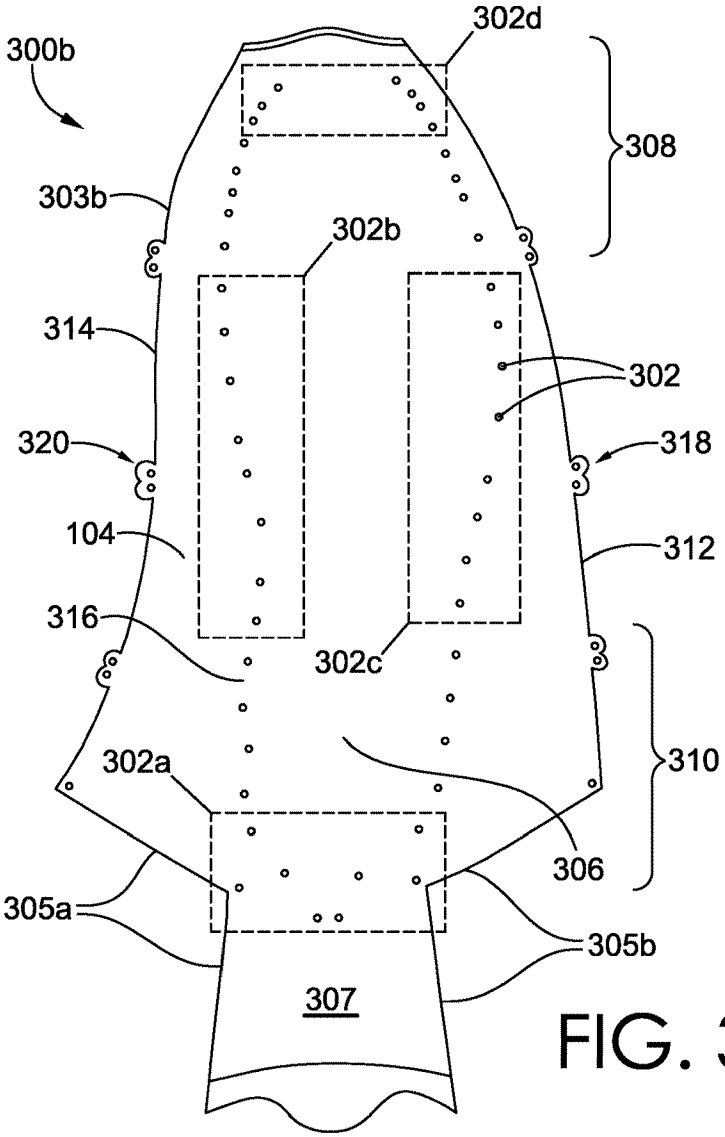
FIGS. 3A and 3B depict an upper of an article of footwear, in accordance with examples of this disclosure.
Figure 3A:
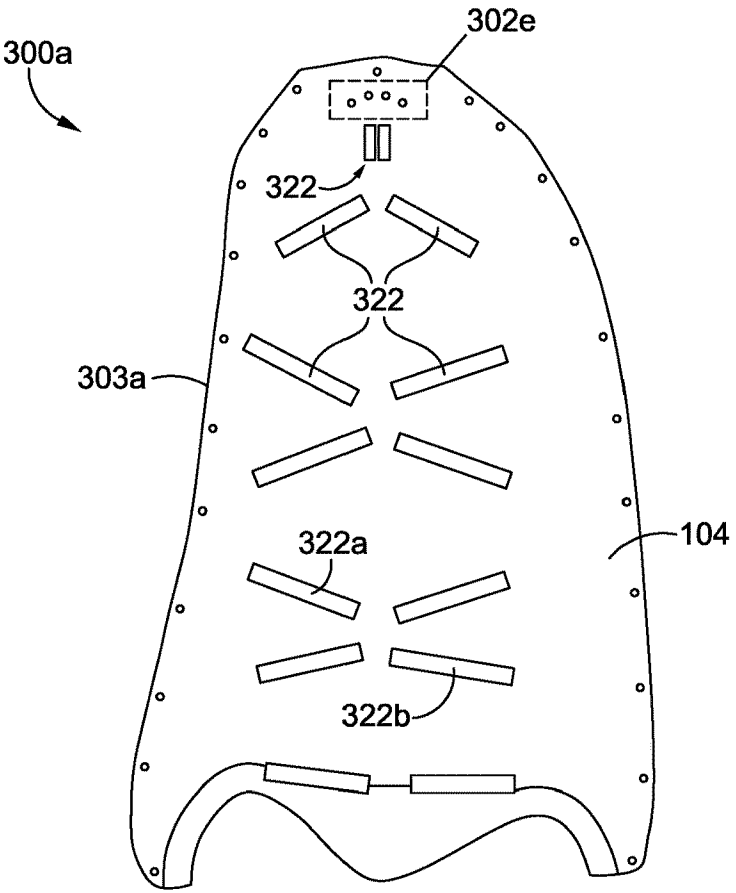

In examples, FIG. 3A depicts a first upper component 300*a*, and FIG. 3B depicts a second upper component 300*b*. In accordance with some examples, the first upper component 300*a* and the second upper component 300*b* can be assembled (e.g., coupled together along a seam) to form the upper 104 of FIGS. 1A and 1B. For instance, the first upper component 300*a* and the second upper component 300*b* (e.g., edges of the components 300*a* and 300*b*) can be connected to one another along a seam 142 (e.g., as shown in FIG. 1A and FIG. 1B), such as by stitching, seam tape, etc.

FIG. 3A illustrates a top, plan view of the upper component 300*a*, and FIG. 3B illustrates a top, plan view of the upper component 300*b* in an unfolded configuration. The upper components 300*a* and 300*b* can be assembled to include the same or similar features as the upper 104. For example, the upper component 300*a* (e.g., vamp portion) can include a portion configured to enclose at least a portion of a dorsal part of a wearer's foot, and the upper component 300*b* can be configured to extend beneath the plantar region of the wearer's foot. In various examples, the upper components 300*a* and 300*b* form the entire or substantially the entire upper and may incorporate various types of yarns to impart different properties to separate areas of the upper.

In at least some examples, the upper component 300*a* can include a free edge 303*a* that is affixed (e.g., via stitching, seam tape, etc.) to a free edge 303*b* of the upper component 300*b* (e.g., along the seam 142 in FIG. 1A and FIG. 1B). In addition, the upper component 300*b* can include free edges 305*a* and free edges 305*b* in the heel region that are affixed together (e.g., via stitching, seam tape, etc.) along seams to at least partially enclose the heel end of the upper 104. That is, the heel flap 307 can be folded up, the two edges 305*a* can be seamed together, and the two edges 305*b* can be seamed together.

The first upper component 300*a* and the second upper component 300*b* may incorporate various types of yarn that impart different properties to separate areas of the upper 104. That is, one area of the first upper component 300*a* and/or the second upper component 300*b* may be formed from a first type of yarn that imparts a first set of properties, and another area may be formed from a second type of yarn that imparts a second set of properties. In this configuration, properties may vary throughout the upper 104 by selecting specific yarns for different areas of the first upper component 300*a* and the second upper component 300*b*. The properties that a particular type of yarn will impart to an area of the first upper component 300*a* and/or the second upper component 300*b* partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the yarns selected for the knitted component 140 may affect the properties of the upper 104. For example, a yarn forming the first upper component 300*a* and/or the second upper component 300*b* may be a monofilament yarn or a multifilament yarn. As such, unless otherwise specified, the term "yarn," as used herein, does not require multiple filaments or fibers. The yarn may also include separate filaments that are each formed of different materials. In addition, the yarn may include filaments that are each formed of two or more different materials, such as a multi-component yarn (e.g., bicomponent yarn) with filaments having a sheath-core configuration or two halves formed of different materials. Different degrees of twist and crimping, as well as different deniers, may also affect the properties of the upper 104. Accordingly, both the materials forming the yarn and other aspects of the yarn may be selected to impart a variety of properties to separate areas of the upper 104.

The first upper component 300*a* and the second upper component 300*b* are illustrated as discrete components that might be knit as separate pieces and then affixed to one another to form the upper 104. In some examples, the first upper component 300*a* and the second upper component 300*b* can be integrally knit as a single knit component during a knitting process, such as weft knitting, warp knitting, or any other suitable knitting process. Forming the upper 104 with the knitted component may provide the upper 104 with advantageous characteristics including, but not limited to, a particular degree of elasticity, breathability, bendability, strength, moisture absorption, weight, abrasion resistance, and/or a combination thereof. Further, forming the upper 104 from an integrally knit knitted component may form various features and structures of the upper 104 without the need for significant additional manufacturing steps or processes, thereby increasing production efficiency.

In at least some examples, the upper component 300*b* can include various apertures 302*a*-302*d* that extend entirely through the thickness of the upper component 300*b*. For example, the apertures 302 can include one or more heel apertures 302*a* in a heel region 310 of the upper component, one or more medial side apertures 302*b* positioned along a medial side of the upper component 300*b*, one or more lateral side apertures 302*c* positioned along the lateral side of the upper component, and one or more forefoot apertures 302*d* positioned in a forefoot region 308 of the upper component 300*b*. In addition, the upper component 300*a* can also include apertures 302*e* in the forefoot region (e.g., top of the toe box). In examples, the apertures 302*a*-302*e* can threadably receive one or more cables (e.g., cable 107 in FIG. 1A) for attaching the upper components 300*a* and 300*b* to one or more components associated with a sole (e.g., the sole 102). In cases where the upper comprises or is formed from a knitted component, the upper apertures 302*a*-302*e* may be integrally knit with the upper. That is to say, the upper apertures 302*a*-302*e* may be formed during the knitting process.

As shown in FIG. 3B, the plurality of upper apertures 302*a*-302*d* may be positioned around a perimeter of an underfoot portion 306 (e.g., strobel) of the upper component 300*b*. That is, apertures of the plurality of upper apertures 302*a*-302*d* may be positioned in the underfoot portion 306 and proximate to a transition from the underfoot portion 306 to the sides of the upper (e.g., the medial and lateral sides). In at least some examples, apertures 302*d* in the forefoot region 308 (or located closer to the forefoot region 308 than the heel region 310) may comprise a higher density (e.g., linear density) of apertures as compared to apertures 302*a*, 302*b*, and 302*c* in other regions, in order to provide enhanced stability (e.g., higher density of cable threading) in or near the forefoot region 308, for example.

In some cases, the plurality of upper apertures 302*a*-302*d* may be positioned in a peripheral margin 316 that extends around the underfoot portion 306. In some examples, the peripheral margin 316 may form a boundary around (or circumscribe) a spacer knit associated with the underfoot portion 306. In some examples, the peripheral margin 316 associated with the underfoot portion 306 can overlap with the spacer knit, such that the apertures 302*a*-302*d* extend through at least a portion of the spacer knit. Further, the peripheral margin 316 may be integrally knit with the upper component 300*b*. Because the plurality of upper apertures 302*a*-302*d* are positioned in the peripheral margin 316, and/or because the spacer knit is located inside the boundary formed by the underfoot peripheral margin 316, when a foot is placed in the article of footwear, the foot may be cushioned or separated from a cable passing through the plurality of upper apertures 302*a*-302*d*. Moreover, in some embodiments, the plurality of upper apertures 302*a*-302*d* may be positioned in the second (e.g., bottom) layer 210 but not the first (e.g., top) layer 208 such that when a cable (e.g., the cable 107) passes through the first plurality of upper apertures, the cable passes through the second layer 210 and into interstitial space between the first and second layers 208, 210 without passing through the first layer 208—minimizing or eliminating contact between the cable and a wearer's foot when the article of footwear is in an as-worn configuration.

In at least some examples, the upper component 300*b* can include one or more lateral cable anchors 318 and one or more medial cable anchors 320, which can comprise a portion of the closure system for adjusting a size or fit associated with the upper 104. For example, once the upper component 300*a* has been affixed to the upper component 300*b*, the lateral cable anchors 318 and the medial cable anchors 320 can threadably receive a cable 120 of the closure system. In at least some examples, the upper component 300*b* includes a lateral panel 312 (e.g., panel, wing, extension, quarter, etc.) and a medial panel 314 (e.g., panel, wing, extension, quarter, etc.) that extend from respective sides of the underfoot portion (e.g., is integrally knit with the underfoot portion in some examples). In examples, the lateral panel 312 and the medial panel 314 can be folded upwards to attach to the upper component 300*a* when forming an upper (e.g., the upper 104). In some examples, the lateral panel 312, the medial panel 314, and/or the margin 316 can comprise a lower peripheral margin associated with the upper (e.g., the upper 104). In FIG. 3B, the cable anchors (e.g., 318 and 320) are depicted in association with the upper component 300*b*. In some examples, one or more cable anchors (e.g., similar to the cable anchors 318 and 320) can be integrally formed with the upper component 300*a* (e.g., also formed on the upper component 300*a* or alternatively formed on the upper component 300*b*).

Figure 2A:
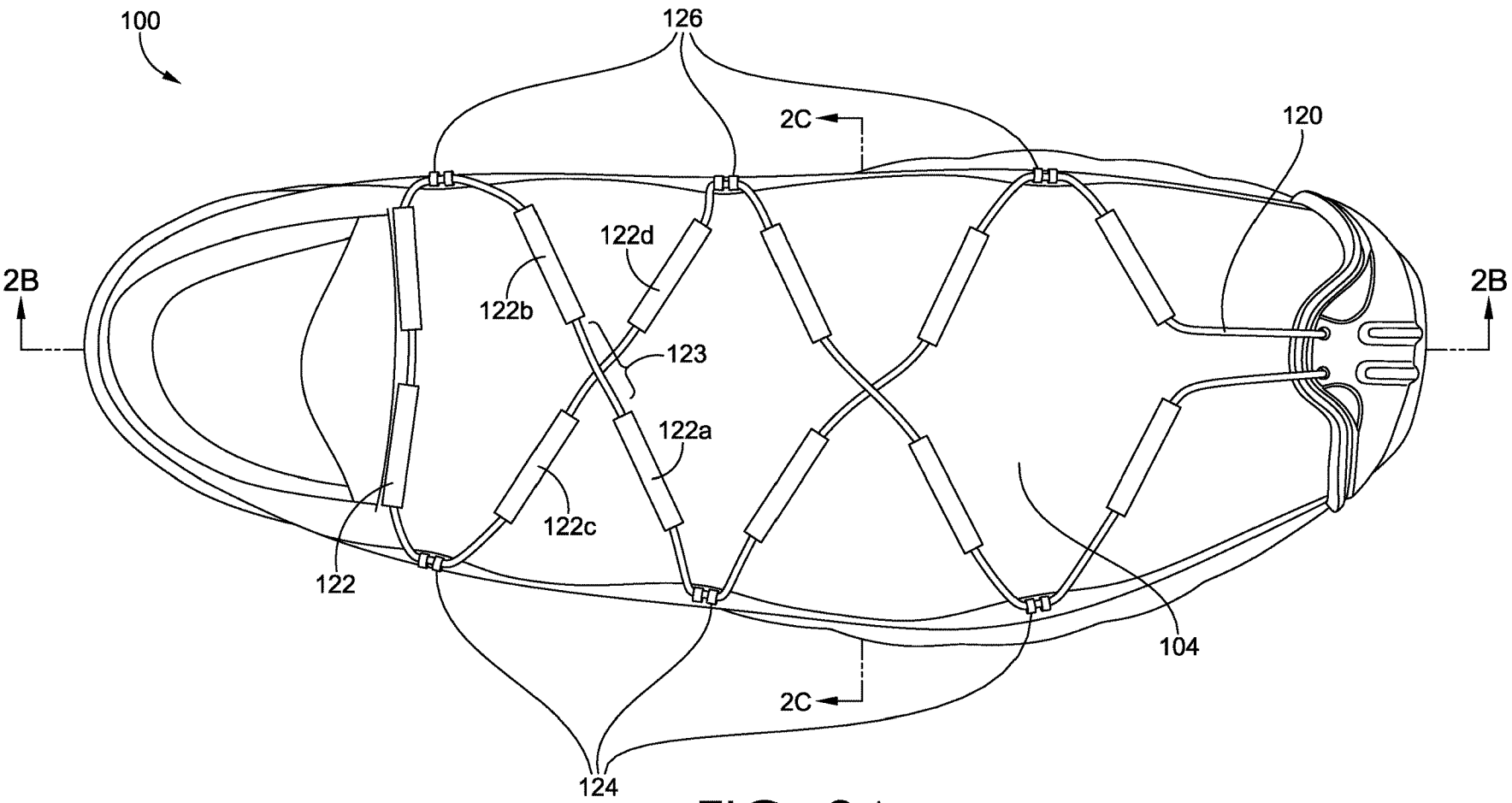
FIG. 2A depicts a top view of an article of footwear, in accordance with examples of this disclosure.

Referring back to FIGS. 1A and 1B, and also FIG. 2A, the upper 104 may comprise one or more lateral anchor points 124 (e.g., same as or similar to the lateral anchor points 318) positioned on the lateral side 114 and one or more medial anchor points 126 (e.g., same as or similar to the medial anchor points 320) on the medial side 116. The lateral anchor points 124 and the medial anchor points 126 may comprise a loop, hook, or other structure having an opening for threadably and slidably receiving the cable 120. For example, the lateral and medial anchor points 124 and 126 may comprise openings configured to frictionally engage the cable when threaded through and to limit side-to-side movement of the cable. In some examples, the lateral anchor points 124 and the medial anchor points 126 may be integrally knit with the knitted component. For example, referring back briefly to FIG. 3B, the anchor points 318 and 320 can be knitted with the upper component 300*b*, and then when assembled with the upper component 300*a* (e.g., along the seam 142), then the anchor points 318 and 320 can form the lateral anchor points 124 and the medial anchor points 126. Although the upper 104 is depicted as comprising three lateral anchor points 124 and three medial anchor points 126, it is contemplated that the upper 104 may comprise more or fewer lateral and/or medial anchor points 124 and 126. It is further contemplated that the upper 104 may comprise one or more additional anchor points on a superior surface of the upper 104—e.g., at a location at which a first portion of the cable 120 (which may be the same cable as the cable 107) intersects a second portion of the cable 120.

The upper 104 may further comprise one or more tubular encasements 122 positioned on an outward-facing surface of the upper 104 (e.g., tubular encasements 322 depicted in association with the upper component 300*a*). The tubular encasement(s) 122 may be configured to receive a cable, such as the cable 120. For example, the tubular encasement(s) 122 may comprise a tubular wall having an internal diameter (or other internal width) large enough to receive the cable 120 and small enough to limit the cable's lateral, or side-to-side, movement within the tubular encasement(s) 122. The tubular encasement(s) 122 may be positioned such that they guide the cable 120 in a desired path or pattern.

In some examples, referring to FIG. 2A and FIG. 3A, the arrangement or the array of the tubular encasements 322 can include various properties. In at least some examples, the tubular encasements 322 can include a first tubular encasement (e.g., 122*a* or 322*a*) that is more laterally oriented and a second tubular encasement (e.g., 122*b* or 322*b*) that is more medially oriented (e.g., relative to the first tubular encasement). In some examples, the first tubular encasement and the second tubular encasement can be aligned (e.g., axially aligned) between a lateral-side anchor 124 and a medial-side anchor 126, such that when a cable is threaded through the first tubular encasement 122*a*/322*a* and the second tubular encasement 122*b*/322*b*, the tubular encasements provide a conduit directing the cable between the anchors. In some examples, the terminal ends of the tubular encasements are spaced apart from one another (e.g., see space or gap 123), which can improve the threadability associated with the tubular encasements. That is, when a needle is used to thread the cable through the tubular encasements, the gap 123 between the tubular-encasement terminal ends can improve threading operations by improving the ability of the point of the needle to be directed through the tubular encasements. In addition, the gap 123 can reduce the likelihood that a cable is damaged when threading, such as when the cable crisscrosses, by reducing the likelihood that a needle point could puncture or damage the other crisscrossing cable. The gap 123 can also reduce the likelihood that, during threading operations, a needle is blocked or impeded from being threaded by a crisscrossing cable. In at least some examples, the first tubular encasement 122*a*/322*a* and the second tubular encasement 122*b*/322*b* can be generally aligned (e.g., generally aligned along respective axes) along a first orientation and a second pair of tubular encasements (e.g., 122*c* and 122*d*) can be generally aligned along a second orientation, which comprises a crisscrossing or "X-shaped" pattern. In some examples, this pattern that crosses on the dorsal portion of the upper can contribute to relatively even distribution of tension among the lacing system. In some embodiments, the tubular encasement(s) 122 may be integrally knit with the knitted component. In some examples the tubular encasements 122 can be discrete tubular cable guides that are affixed to the upper.

Figure 2B:
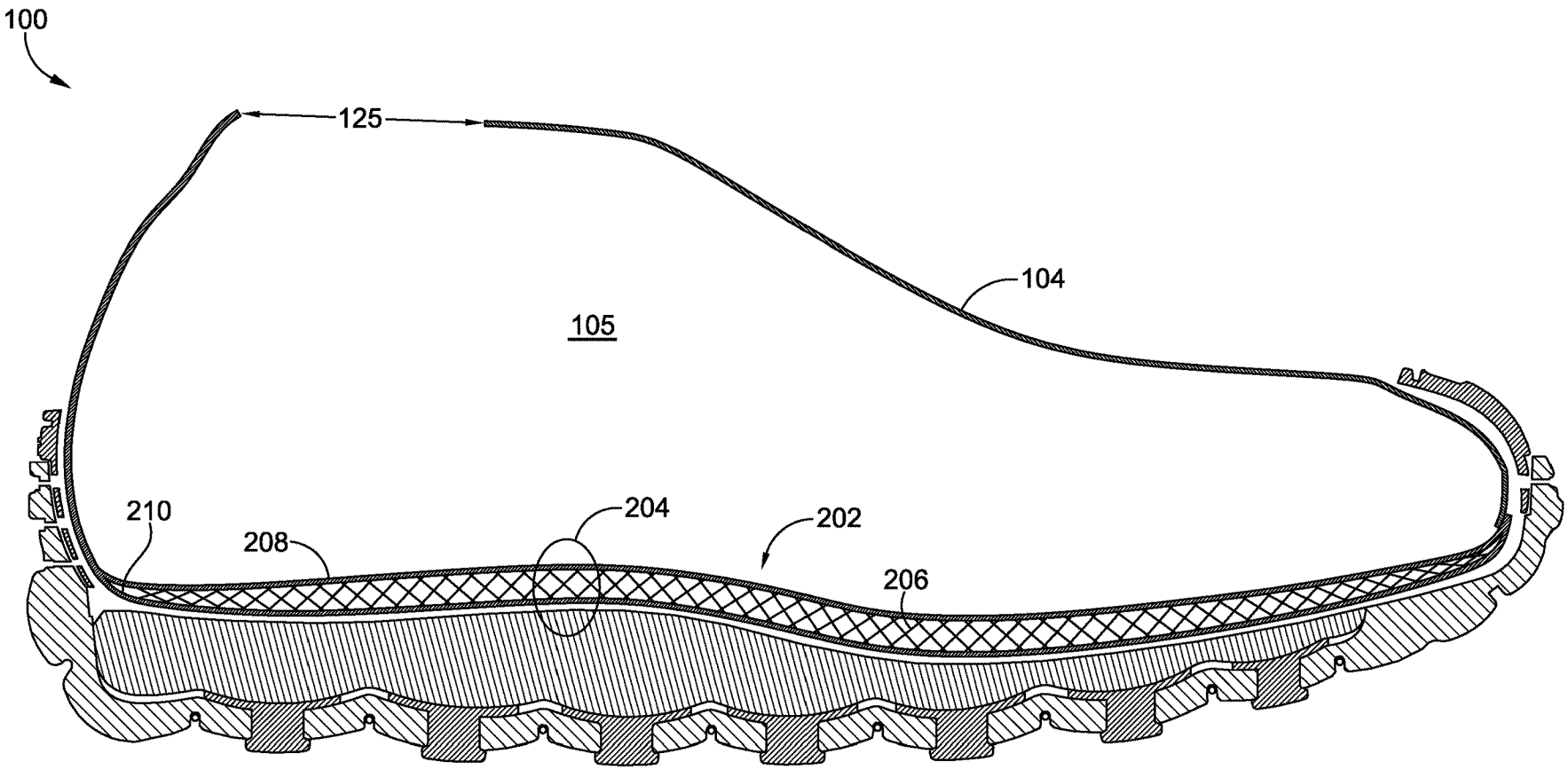
FIG. 2B depicts a cross sectional view associated with FIG. 2A, in accordance with examples of this disclosure.
Figure 2C:
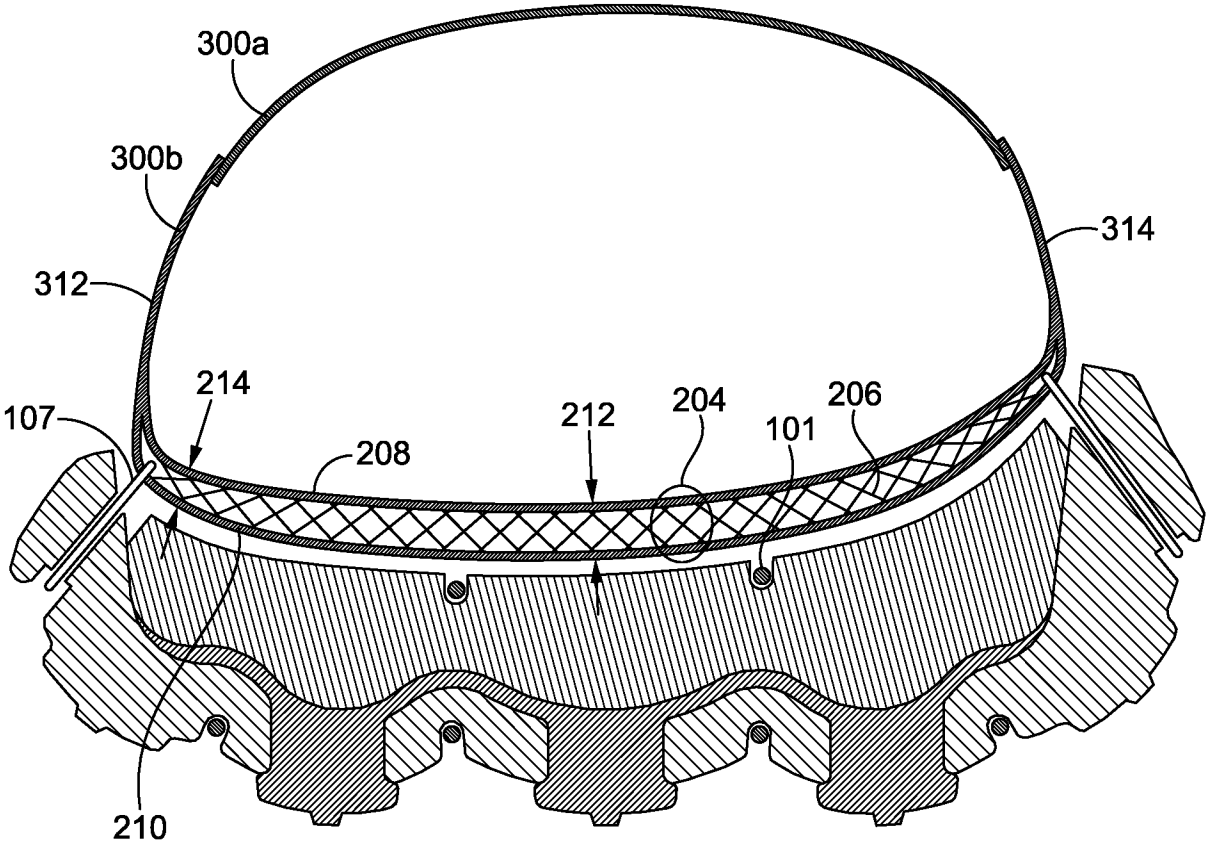
FIG. 2C depicts a cross sectional view associated with FIG. 2A, in accordance with examples of this disclosure.

Referring to FIGS. 2B and 2C, cross-sectional views of the article of footwear 100 are shown, based on the cross-sectional references associated with FIG. 2A. As depicted in FIGS. 2B and 2C, the upper 104 (e.g., 300*a* and 300*b*) may comprise a spacer-knit textile 204 (e.g., associated with the underfoot portion 306, which can also be referred to as a strobel). The spacer-knit textile 204 may be defined by a first layer 208 (e.g., first knit layer) and a second layer 210 (e.g., second knit layer 210) and a plurality of tie yarns 206 extending between a first layer 208 and a second layer 210 (e.g., across the interstitial space between the first layer 208 and the second layer 210).

The tie yarns 206 can be made from monofilaments or other suitable materials. For example, the tie yarns 206 (and yarns comprising the first layer 208 and the second layer 210) can be made of polyester (e.g., PET) or recycled polyester (e.g., rPET). In some examples, the yarns can comprise one end, two ends, three ends, or more than three ends. In some instances including three ends, each can include a diameter between about 0.15 mm and 0.30 mm. In at least one example, the three ends of the tie yarn include one end with a diameter of 0.20 mm and two ends with a diameter of 0.25 mm. In at least some examples, this diameter and associated denier (which can be larger than in at least some other spacer-knit textiles) can contribute to the operability of the spacer-knit textile 204 in the underfoot region. For example, this denier can contribute to the cushioning imparted by the spacer-knit textile 204, as well as the ability of the spacer-knit textile 204 to rebound. However, this is merely an example, and it is contemplated that the yarns may comprise any number of yarns and any combination of diameters thereof.

The tie yarns 206 can extend substantially perpendicularly to the first and/or second knit layers 208, 210, extend at an angle other than ninety degrees, and/or can zigzag between the first and second layers 208, 210. For example, the tie yarns 206 (or a subset of the tie yarns) can extend at an angle of about 45 degrees (e.g., between 30 and 60 degrees) relative to the first and/or second knit layers 208, 210. That is, if the bottom layer 210 is set on a horizontal surface (e.g., a table), then, in some examples, at least some of the tie yarns 206 can extend at an angle from bottom layer 210 and towards the top layer 208, and the angle can be in a range of about 30 degrees to about 60 degrees. In at least some examples, the angled orientation of the tie yarns 206 can contribute to the operability of the spacer-knit textile 204 in the underfoot region. For example, in some instances, a more angled orientation, as opposed to a more vertical orientation, can increase the operation of the spacer-knit textile 204 to compress in a more superior-inferior orientation (e.g., like an accordion). On the other hand, in a spacer-knit textile with more vertically oriented tie yarn, the top layer can be more likely to shift (e.g., relative to the bottom layer) in the medial-lateral orientation and/or the fore-aft orientation, which could be undesirable and create a slipping sensation (e.g., for the wearer) in the footbed. As such, such a configuration (i.e., where the tie yarns 206 are not perpendicular to the first or second knit layers) may enhance the stability of the underfoot portion. The tie yarns 206 can further couple and/or provide spacing between the first and second layers 208, 210. The tie yarns can further imbue the underfoot portion with a rebound effect.

As described, the spacer-knit textile 204 may be positioned in an underfoot portion of the upper 104 (e.g., the underfoot portion 306 of the upper component 300*b*) and may be circumscribed by an underfoot peripheral margin (e.g., the underfoot peripheral margin 316) and/or by a plurality of upper apertures (e.g., the plurality of upper apertures 302*a*-300*d*). In some examples, the spacer-knit textile 204 can span an entire length and/or an entire width of the underfoot portion. In some examples, the spacer-knit textile 204 can extend only partially across a width and/or only partially the length of the underfoot portion. In at least some examples, the spacer-knit textile 204 can include one or more thicknesses (e.g., between a superior face of the top layer 208 and an inferior face of the bottom layer 210) at one or more positions. For example, the spacer-knit textile 204 can include a first thickness 212 in a more central region (e.g., near, or at least partially along, a longitudinal midline) and a second thickness 214 in a more peripheral region (e.g., near the peripheral edge of the spacer-knit textile). Alternatively or additionally, the second thickness can be closer to a toe portion, lateral side, medial side, and/or heel portion of the upper 104, the spacer-knit textile 204, and/or the article of footwear than the first thickness. In examples, the first thickness is measured at an intersection of a longitudinal midline and a lateral midline—e.g., a center point of the upper 104, the spacer-knit textile 204, and/or the article of footwear. In some examples, the first thickness 212 is larger than the second thickness 214, such that the spacer-knit textile gradually tapers in thickness from the more central region to the more peripheral region. The thickness can taper while moving away from the first thickness in a lateral direction, a longitudinal direction, or any other direction. In at least some examples, the first thickness 212 can be at least about 10 mm. In some instances, the first thickness 212 being at least about 10 mm can contribute to cushioning associated with the spacer-knit textile 204 and can contribute to a rebound associated with the spacer-knit textile 204. The first thickness 212 can, in some examples, reduce the likelihood that a wearer might feel, or experience irritation by, the cable 101 and/or the cable 107. In at least some examples, the angle of the tie yarns 206 can vary from one region of the spacer-knit textile 204 to another. For example, tie yarns that are in a more central region can include a first angular orientation, and tie yarns that are more peripheral can include a second angular orientation that is less (e.g., flatter or more horizontal) than the first angular orientation. In examples, the transition in angular orientation can contribute to the tapering thickness of the spacer-knit textile.

Referring to FIG. 2C, in some examples, the plurality of upper apertures (e.g., 302*a*-302*d*) can be positioned in the second (e.g., bottom) layer 210, such that when the cable 107 passes through the plurality of upper apertures, the cable 107 passes through the second layer 210 and into interstitial space between the first and second layers 208, 210 without passing through the first layer 208. In at least some examples, this structure and arrangement can minimize or eliminate contact between the cable 107 and a wearer's foot when the article of footwear is in an as-worn configuration, which can reduce the likelihood of the cable 107 causing irritation and/or discomfort.

In some examples, the spacer-knit textile 204 may be integrally knitted with the upper. For example, the spacer-knit textile 204 can be integrally knit with the lateral panel 312 and/or with the medial panel 314. In some instances, integrally knitting the spacer-knit textile 204 with the upper (e.g., with the lateral and/or medial panels) can contribute to the sustainability of the footwear article 100 in one or more various respects. For example, integrally knitting the spacer-knit textile 204 can reduce (e.g., eliminate) the need for a sockliner or insole, which can reduce the overall number of parts to be manufactured, assembled, used to install the sockliner, etc. In addition, the spacer-knit textile 204 can be constructed from yarn of the same material (e.g., PET or rPET) as other parts of the upper, which can allow the upper and the spacer-knit textile 204 to be recycled together in the same process (e.g., shredding or re-pelletizing).

Example Sole Components for Articles of Footwear

Figure 4:
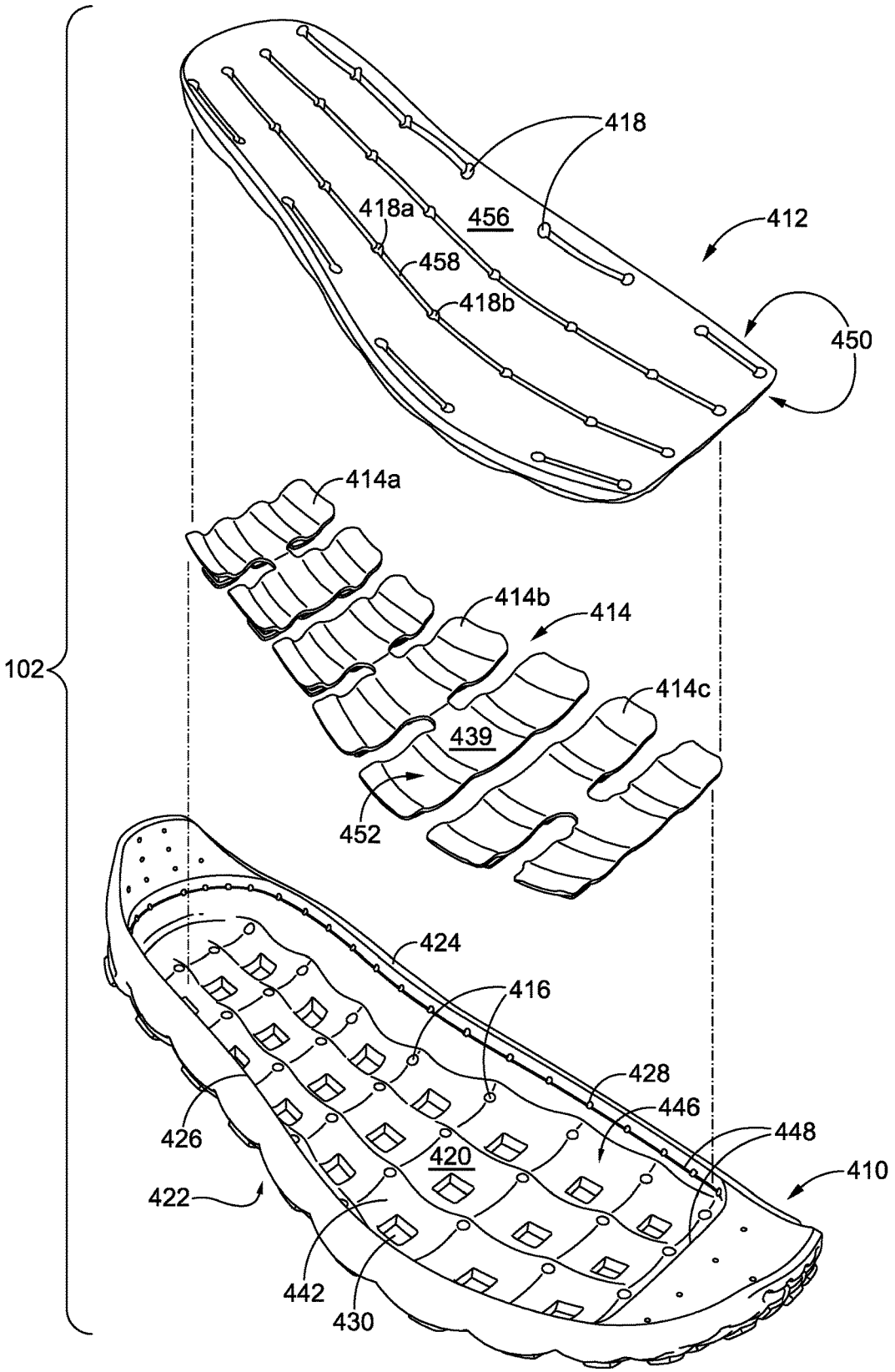
FIG. 4 depicts an exploded top perspective view of a sole structure of an article of footwear, in accordance with examples of this disclosure.

Referring to FIG. 4, an example associated with the sole 102 is depicted. In at least some examples, the sole 102 can include a plurality of layers, such as one or more midsole components and one or more outsole components, that are stacked one atop the other and affixed together via a cable (e.g., the cable 101 illustrated in FIG. 1 but omitted from the depiction in FIG. 4). In some examples, the one or more layers or components can include a midsole carrier component 410, a midsole core component 412, and one or more outsole components 414 (e.g., with one or more outsole parts 414*a*, 414*b*, and 414*c*). In some instances, the one or more layers or components 410, 412, and 414 can include different compositional materials. For example, at least one of the midsole carrier 410 and the midsole core 412 can include a compressible polymer foam element (e.g., polyurethane foam, ethylene-vinyl acetate (EVA) foam, phylon, etc.). In some constructions, these materials can be configured to help attenuate ground reaction forces (e.g., provide cushioning) when compressed between the foot and the ground during walking, running, or other ambulatory activities. In some examples, at least one of the midsole carrier 410 and the midsole core 412 can include fluid-filled chambers, plates, moderators, or other elements configured to attenuate forces, enhance stability, or influence motions of the foot, and these elements can be constructed of a polymer (e.g., polyurethane, thermoplastic polyurethane, carbon fiber etc.), foam material, or other materials. In at least some examples, the outsole component(s) 414 can include a wear-resistant rubber material configured to impart traction and provide wear resistance to the ground-facing surface of the sole 102 (e.g., forming a "ground-contacting element).

In at least some examples, a cable can pass through a series of holes or apertures (e.g., 416 and 418) among the plurality of layers or components 410, 412, and/or 414 and can be secured thereto (e.g., by tying, hardware, etc.). In at least some examples, the plurality of layers or components 410, 412, and 414 can be free (or substantially free) of other, non-cable connections (e.g., chemical adhesives, fused connections (e.g., thermal bonding structures), ultrasonic welding, etc.) for attaching one layer to another layer. As such, in at least some examples, the sole 102 can be deconstructed by unthreading the cable (e.g., 101) to disconnect one part of the sole 102 from another part of the sole 102. In addition, based on the omission of the non-cable connections, when the sole is 102 deconstructed, the parts can be free from contamination from each other (e.g., pieces of one part of the sole do not remain bonded to another part of the sole). As such, in some examples, the parts can be better suited for recycling (e.g., re-pelletizing), since the parts include a more pure form of the compositional material that is not contaminated by the material of other parts. In addition, one or more of the parts can be reused in a subsequent footwear article (e.g., by attaching with the cable or with a new cable).

Figure 5:
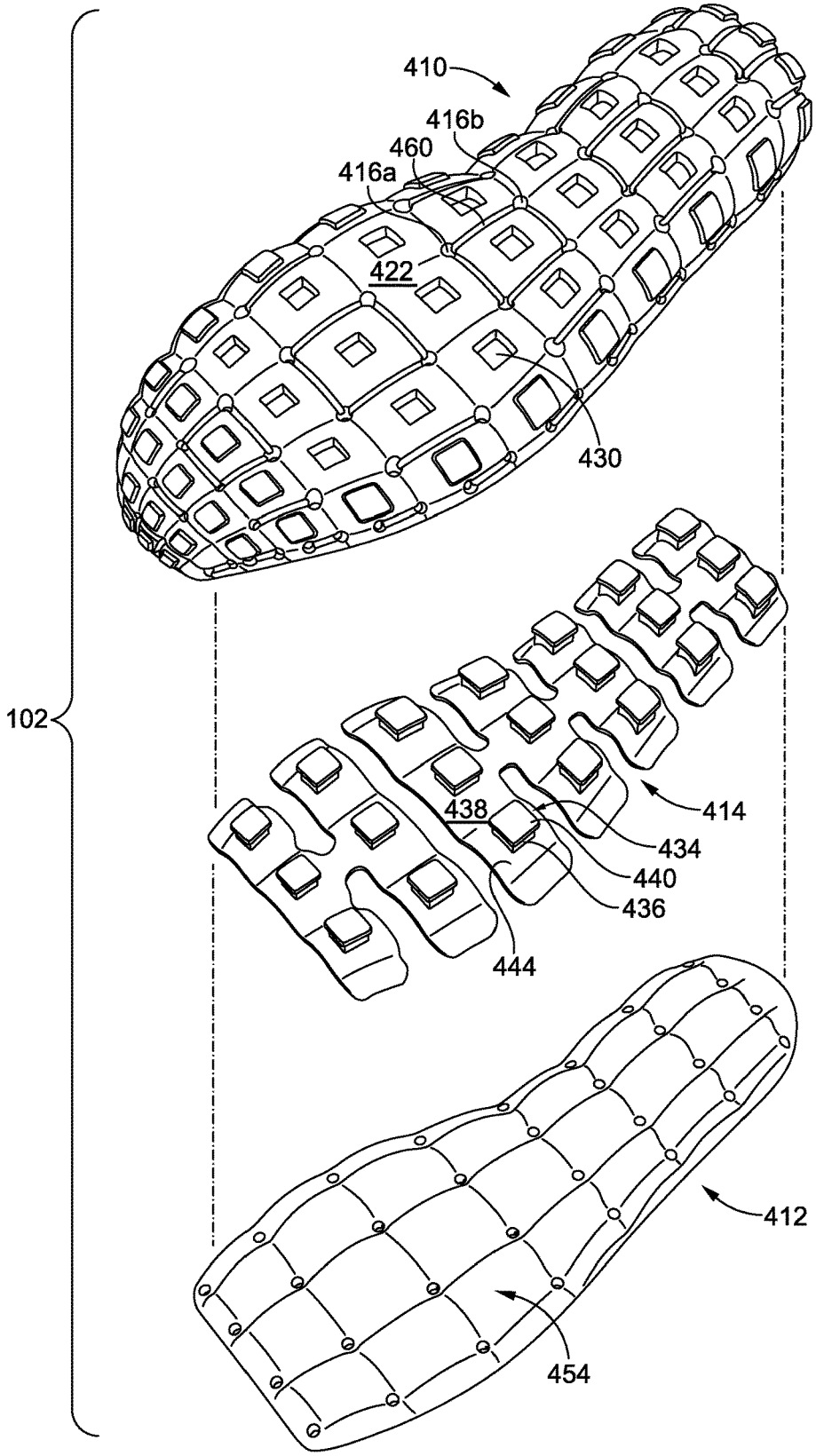
FIG. 5 depicts an exploded bottom perspective view of a sole structure of an article of footwear, in accordance with examples of this disclosure.

Various features can contribute to the operations and functionality associated with the sole 102, such as deconstructability, impact attenuation, comfort, support, stability, motion control, etc. For instance, in at least some examples, the midsole carrier 410 can be configured to support, or provide a foundation or mounting structure for, one or more layers of the sole 102. For example, the midsole carrier 410 supports the midsole core 412, as well as the outsole component(s) 414 captured between the midsole carrier 410 and the midsole core 412. In at least some examples, the midsole carrier 410 can include a superior surface 420, which faces toward the foot-receiving cavity when the sole 102 is assembled with an upper, and an inferior surface 422 (as shown in FIG. 5), which generally faces away from the foot-receiving cavity, in a direction opposite to the superior surface, and towards a ground surface (e.g., ground-facing surface). In addition, the midsole carrier 410 can include one or more sidewalls 424 and 426 that extend upward and form a perimeter wall around at least a portion of the superior surface 420. As such, in at least some examples the superior surface 420 can be associated with a recessed portion (e.g., 446). In at least some examples, the superior surface 420 smoothly transitions or curves as it transitions from the more interior portion of the midsole carrier 410 to the sidewalls 424 and 426. As such, this top or superior portion of the midsole carrier 410 can include a cavity for housing at least a portion of the midsole core 412 and the outsole component(s) 414. In addition, in some instances, the sidewalls 424 and 426 can operate to connect to the upper 104, such as the upper 104 via the cable 107. That is, in some examples, the midsole carrier 410 can include apertures 428 (e.g., sidewall apertures) for receiving the cable 107 to attach the upper 104 (e.g., via the apertures 302*a-d*) to the sole 102.

Figure 6A:
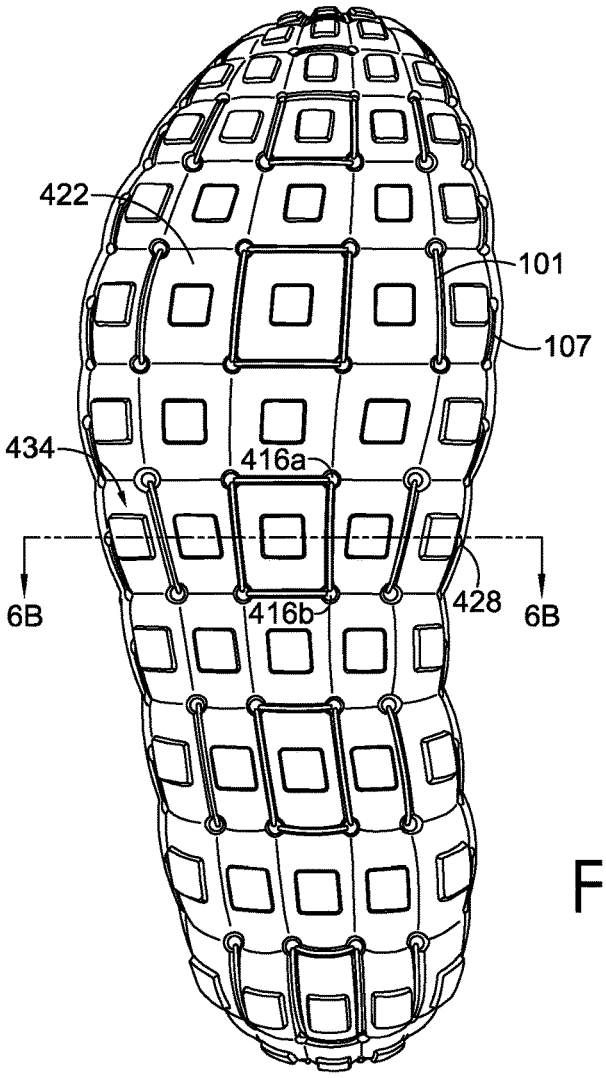
FIG. 6A depicts a bottom plan view of a sole structure for an article of footwear, in accordance with examples of this disclosure.
Figure 6B:
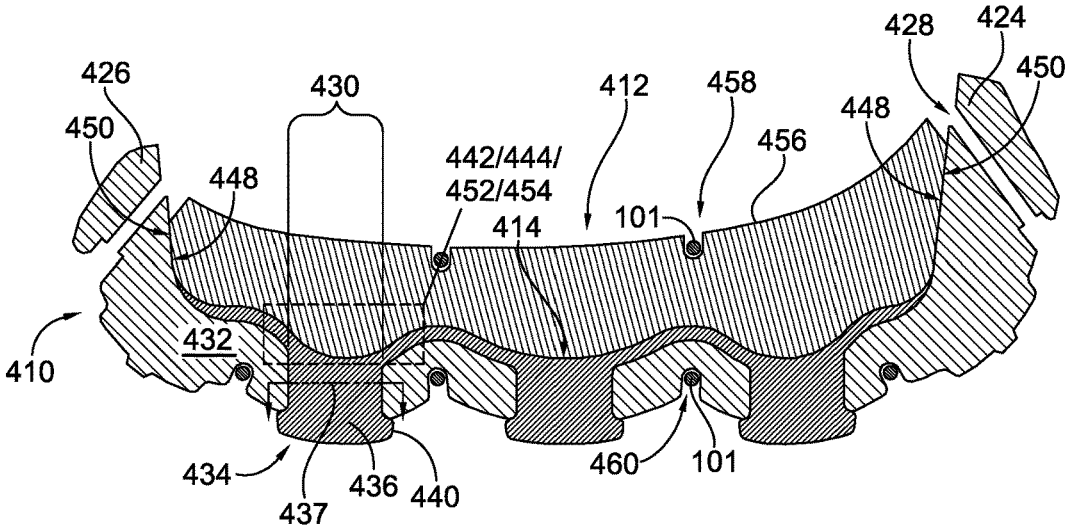
FIG. 6B depicts a cross-sectional view associated with FIG. 6A, in accordance with examples of this disclosure.

In some examples, the midsole carrier 410 includes one or more through holes 430 that extend from the superior surface 420, through a stratum 432 (e.g., as shown in FIG. 6B) of the midsole carrier 410, and to the inferior surface 422. In at least some examples, the through hole 430 is configured to receive a traction lug 434 (e.g., obscured from view in FIG. 4 and shown in FIG. 5) of the outsole component(s) 414. For example, FIGS. 4 and 5 depict the outsole component(s) 414 with the traction lug 434 decoupled from the midsole carrier 410, and FIGS. 6A and 6B depict an example in which the traction lug 434 is received in the through hole 430. In at least some examples, the traction lug 434 can include a trunk or base (e.g., 436) that protrudes from an inferior surface (e.g., 438) of the outsole layer 414. That is, the outsole component(s) 414 can include a relatively thin and broad plate body that forms a base or foundation from which the trunk 436 of the lug 434 can extend. In addition, the traction lug 434 can include a protuberance 440 (e.g., protruding rib) that extends outward from the trunk 436 (e.g., forming an overhang). Although parts of this specification might refer to a single traction lug 434 when describing examples associated with traction lugs in general, in some examples, the outsole component(s) 414 can include several traction lugs (e.g., as illustrated in the figures).

In at least some examples, the through hole 430 and the traction lug 434 can include a similar shape (e.g., both the through hole 430 and the traction lug 434 can be rectangular, ovular, circular, or a variety of other n-side shapes). For example, the through hole 430 can include a hole profile shape, and the trunk 436 of the traction lug 434 can include, in a cross section associated with the reference line 437, a cross-sectional profile shape, which corresponds with (e.g., is keyed to), the hole profile shape. In some examples, the similar shape can include one or more ovular portions or rectilinear portions (e.g., non-circular portions), which can reduce the likelihood of the traction lug rotating relative to the through hole (e.g., when the similar shapes include a similar size and based on the interference between the corresponding portions). For example, the through hole 430 can include at least one straight edge or wall, and the traction lug 434 can also include at least one straight wall, which abuts the straight edge or wall of the through hole 430. In addition (or alternatively), the similar shape can include one or more curves or arcs having different radii (e.g., not a circle). In addition, the traction lug and the through hole can be similarly sized, such that when the traction lug is inserted into the through hole, the perimeter of the through hole 430 can frictionally engage the trunk 436 of the traction lug 434. In some instances, the protuberance 440 can be associated with a larger width than the through hole 430, such that once the traction lug 434 has been inserted in the through hole 430, the protuberance 440 can impede the traction lug 434 from disengaging from the through hole 430. This configuration may also prevent foreign matter from entering the article of footwear via the through hole 430. In at least some examples, the traction lug 434 can snap into place when engaged in the through hole 430, which can interlock the traction lug 434 (and the outsole component) with the midsole carrier 410.

In some examples, the through hole 430 in the midsole carrier 410 can extend from the superior surface 420 of the midsole carrier 410 (e.g., the superior surface facing towards a foot-receiving cavity), through the stratum 432 of the midsole carrier 410, and to the inferior surface 422 of the midsole carrier 410 (e.g., the inferior surface facing away from the foot-receiving cavity). In addition, the superior surface 420 can include, on the portion of the superior surface around the through hole 430, a concave portion 442 or depression (e.g., FIGS. 4 and 6B) that curves into the stratum 432. In at least some examples, the outsole component(s) 414 can include, around the traction lug 434 and on the inferior surface 438 of the outsole layer 414 (e.g., as part of the relatively thin and broad portion of the outsole layer), a convex portion 444 having a contour that corresponds with the concave portion 442 of the superior surface 420 of the midsole carrier 410. For example, the concave portion 442 and the convex portion 444 can include a similar curvature and be associated with similar radii. In examples, the convex portion can be convex in the mediolateral orientation and/or in the anterior-posterior orientation. As such, when the traction lug 434 is mated with the through hole 430, the convex portion 444 of the outsole layer 414 can nest into the concave portion 442 of the superior surface 420 of the midsole carrier 410.

In examples, the outsole component(s) 414 can include one or more drop-in units, each with a respective set of traction lugs for insertion into a respective through hole. For example, in the figures, the outsole layer 414 includes three outsole components 414*a*, 414*b*, and 414*c*. In some examples, the outsole component(s) 414 can include a single drop-in outsole, two drop-in outsoles, or more than three drop-in outsoles. In at least some examples, when assembled with the midsole carrier 410, the drop-ins can be spaced apart to provide openings through which a cable (e.g., 101) can be threaded.

As mentioned, in at least some examples, the midsole core 412 can also be arranged or stacked in the cavity of the midsole carrier 410 and on top of the outsole component(s) 414, such that the outsole component(s) 414 are layered between the midsole carrier 410 and the midsole core 412. In at least some examples, the superior surface 420 of the midsole carrier 410 can include a recess 446 (e.g., FIG. 4) with an outer edge, such as the outer edge segment 448 (e.g., some of which can also be associated with one or more of the sidewalls 424 and 426) that defines a recess profile or shape. In some instances, the midsole core 412 can include a perimeter, terminal edge 450 that also defines a profile shape of the midsole core 412 and that corresponds to the recess shape. As such, the midsole core (e.g., drop-in midsole core) can nest into the recess 446 and atop the outsole component(s) 414.

In at least some examples, a superior surface 439 of the outsole layer 414 can include a concave portion 452 (e.g., FIGS. 4 and 6B) that curves towards the traction lug 434. In examples, the midsole core 412 can include, at a portion aligned with the concave portion 452 of the outsole layer 414, a convex portion 454 having a contour that corresponds with the concave portion 452 of the superior surface 439 of the outsole layer 414. For example, the concave portion 452 and the convex portion 454 can include a similar curvature and be associated with similar radii. In examples, the portions can curve in the mediolateral orientation and/or in the anterior-posterior orientation. As such, when the midsole core 412 is nested in the midsole carrier 410, with the outsole component(s) 414 therebetween, the various face-to-face surfaces (e.g., associated with 442, 444, 452, and/or 454) can be relatively flush to one another, which can reduce the likelihood of corners or edges digging into other layers or creating discomfort for a wearer.

In at least some examples, one or more of the layers can include a surface groove that connects a first through hole to a second through hole. As such, when the cable passes or extends along the surface from the first through hole to the second through hole, the cable can be positioned in the groove, which can protect the cable, impede the cable from shifting side to side, and decrease the likelihood that the cable protrudes from the surface and potentially creates discomfort for the wearer. For example, the superior surface 456 of the midsole core 412 (e.g., facing towards the foot-receiving cavity) can include apertures 418, such as first aperture 418*a* and second aperture 418*b*. The superior surface 456 can also include cable-retaining surface grooves (e.g., 458) that connect (along the superior surface 456) apertures to one another (e.g., that connect the first aperture 418*a* to the second aperture 418*b*). The surface groove 458 can contain the cable 101 (e.g., FIGS. 1 and 6B), can be deep enough to reduce the likelihood of the cable 101 protruding into a footbed of the footwear article, and can impede the cable 101 from sliding out of position. In addition, in some examples, the inferior surface 422 of the midsole carrier 410 (e.g., facing away from the foot-receiving cavity and sometimes facing towards a ground surface when the footwear article is worn) can include portions of the apertures 416 associated with recessed portion 446, such as first aperture 416*a* (e.g., FIGS. 5 and 6A) and second aperture 416*b*. The inferior surface 422 can also include cable-retaining surface grooves (e.g., 460, shown in FIGS. 5 and 6B) that connect (along the inferior surface 422) apertures to one another (e.g., that connect the first aperture 418*a* to the second aperture 418*b*). In examples, the cable-retaining surface grooves can help protect the cable 101 from the ground surface (e.g., reduce fraying, tearing, breakage, etc.) and can impede the cable from sliding out of position.

In at least some examples, the apertures 418 (e.g., apertures in the midsole core 412) may be positioned such that they are in vertical (or substantially vertical) alignment (e.g., in the superior-inferior direction) with apertures 416 in the midsole carrier 410. In some examples, the apertures in sole components can be offset, such that they are angularly aligned (e.g., a cable is angled as it extends from one aperture to the next). Accordingly, in some cases, a cable (e.g., 101) can pass through the apertures 418 and corresponding apertures to couple the midsole core 412 to other portion(s) of the sole 102, such as the midsole carrier 410. In some instances, offsetting the apertures such that the cable is angled can improve threading operations. In some examples, offsetting the apertures such that the cable is angled can reduce the likelihood that the cable is felt by a wearer when ambulating, jumping, etc. (e.g., as compared to vertically aligned apertures or cable segments), since the downward force applied by the wearer is more of an axial force (e.g., angled relative to the cable axis) and less of a compressive force (e.g., more parallel to the cable axis). In some examples, the spacer knit 204 can help to provide a cushion over the cable 101 and can reduce the likelihood that the cable 101 might contribute to discomfort (e.g., in the bottom of the wearer's foot).

In examples, the apertures in the inferior surface 422 may be arranged in one or more rows (e.g., four rows, as shown in FIG. 6A). The rows of apertures may extend in a longitudinal direction. In addition, the arrangement of the apertures in the superior surface 456 can also be arranged in one or more rows (e.g., four rows, as shown in FIG. 4), which may extend in a longitudinal direction. In some examples, the arrangement of apertures 416 and 418 can also be associated with a threading pattern (e.g., an order in which the cable 101 is threaded through the apertures), as described in other parts of this disclosure. Although the inferior and superior surfaces 422, 456 are depicted as comprising four rows of apertures, it is contemplated that said surfaces can contain any number of rows of apertures (e.g., two rows of apertures: one row of apertures on the lateral side and one row of apertures on the medial side). In other embodiments, the apertures may not be organized into rows.

In at least some examples of the present disclosure, the sole 102 can be affixed to the upper 104 via one or more cables and without (or substantially without) other, non-cable couplings (e.g., chemical adhesive, thermal bonding structures, etc.). For example, referring to FIGS. 4, 6A, and 6B, the midsole carrier 410 may comprise sidewall apertures (e.g., sidewall aperture 428), which can extend around the periphery of the midsole carrier component 410 (e.g., may also be referred to as "peripheral apertures"). In examples, the sidewall apertures 428 can extend along the medial side and along the lateral side. In addition, a cable (e.g., 107) can be threaded in and out of the sidewall apertures 428 and the apertures 302*a*-302*d* to couple the upper 104 to the sole 102.

In some examples, positioning the peripheral apertures in sidewall(s) may reduce or eliminate contact between the cable and the ground (or another external surface), improving wearer comfort and reducing cable wear—e.g., compared to embodiments where the peripheral apertures are located more directly beneath a foot of the wearer. In other examples, the apertures may be positioned in other regions of the midsole carrier 410 (e.g., not in a sidewall and/or around a periphery of the midsole carrier 410). Sidewall apertures (e.g., 428) can be connected by surface grooves (e.g., 618) in the same or substantially the same manner as previously described with respect to surface groove 460.

Although the sole 102 is described in some aspects as comprising two or more components (e.g., the midsole carrier 410, the outsole component(s) 414, and the midsole core 412), it is contemplated that the sole 102 can comprise fewer components (e.g., a unit sole) or more components. For example, in some embodiments, the sole 102 is not comprised of components connected to one another using one or more cables. However, in such cases, the sole 102 may still be attached to the upper 104 by one or more cables (e.g., 107). In at least some examples, one or more components of the sole can be combined or omitted. For example, the midsole carrier 410 can be coupled with the outsole components 414, and a midsole core 412 can be omitted, in which case the midsole carrier 410 can still interlock with the outsole component(s) 414. In some instances, the midsole core 414 can be combined with the outsole component(s) 412 into a single component. In some examples, the outsole component(s) 414 can be omitted, and the midsole carrier 410 can still be coupled to the midsole core 412 (e.g., via the cable 101). In some examples, one or more additional components can be included with the sole 102 or with the upper 104 to form at least a portion of a footbed. For example, one or more additional layers or components can be included among the stack of the midsole carrier 410, the midsole core 412, and/or the outsole component(s) 414. In some examples, an insole or other component can be positioned between the midsole core 410 and the foot-receiving cavity (e.g., superior to the midsole core 412).

Example Heel Counters and Toe Caps for Articles of Footwear

Figure 7:
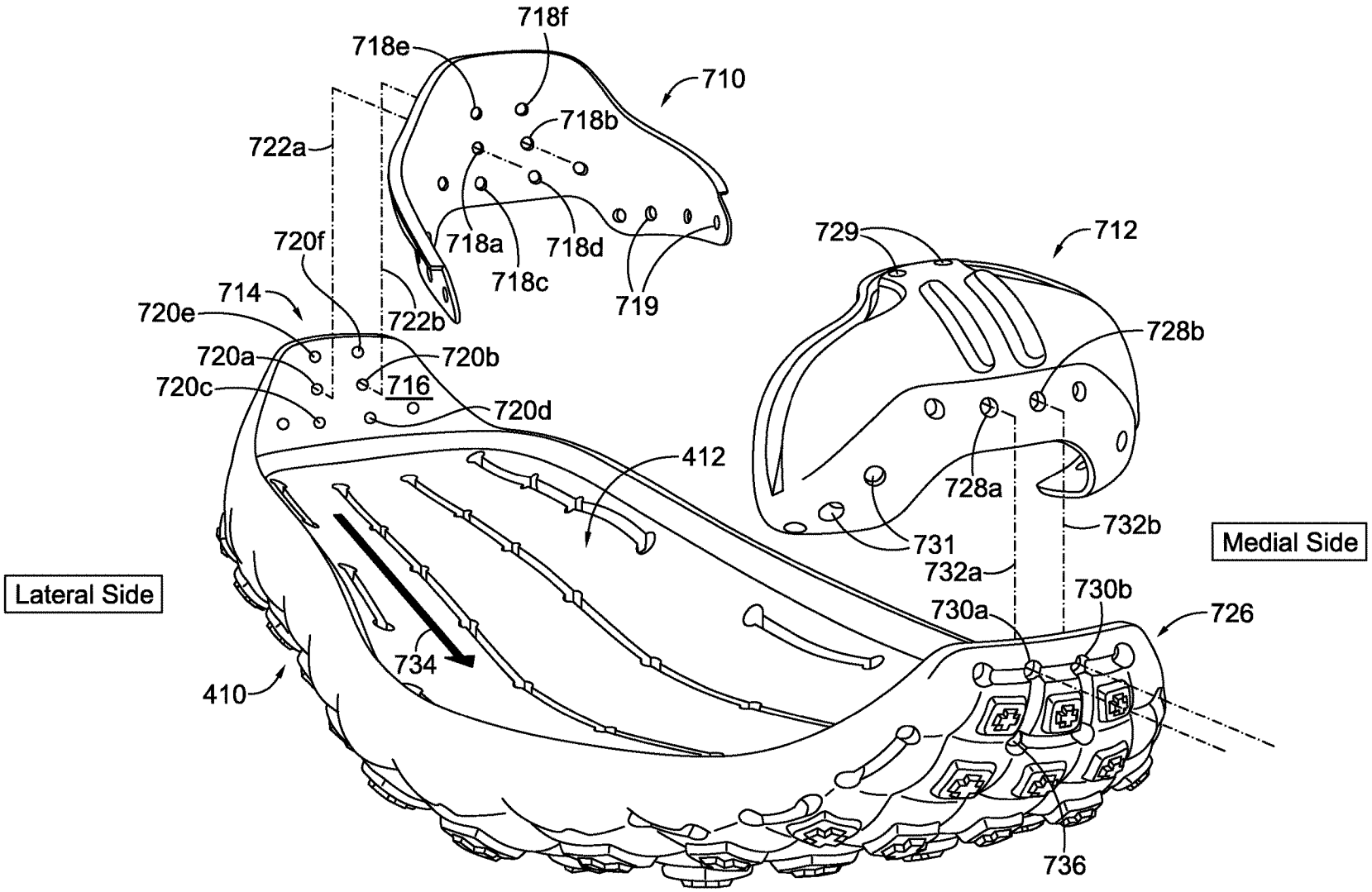
FIG. 7 depicts, in a partially exploded view, a sole structure, a heel counter, and a toe cap for an article of footwear, in accordance with examples of this disclosure.

Referring to FIG. 7, in some examples, the sole 102 can be connected to a heel counter 710 (e.g., the heel counter 118 in FIGS. 1A and 1B). The heel counter 710 can, in some instances, help to reinforce the heel region (e.g., 112) of the midsole carrier 410. For example, midsole carrier 410 can include a heel portion 714 of the midsole carrier sidewall that wraps around the back end of the sole 102 from the medial side to the lateral side. The heel portion 714 can include an inner-facing surface 716 and an outer-facing surface (not shown in FIG. 7). In some examples, the heel counter 710 can be positioned adjacent the inner-facing surface 716, and similar to the heel portion 714, the heel counter 710 can also at least partially wrap around the back end of the sole 102. In some examples, the heel counter 710 can be positioned adjacent the outer-facing surface.

The heel counter 710 can include a series of apertures (e.g., 718*a*-718*f*) that are alignable with apertures (e.g., 720*a*-720*f*) in the heel portion 714 of the midsole carrier 410. In FIG. 7, example reference lines 722*a* and 722*b* are depicted to illustrate an example aperture alignment, with the heel counter 710 arranged adjacent the inner-facing surface 716. In at least some examples, one or more cables can be threaded through the through apertures (e.g., 718*a*-718*f* and 720*a*-720*f*) to affix the heel counter 710 to the midsole carrier 410, and in some examples, also to the upper 104. For example, the cable 101 that attaches the midsole carrier 410 to the midsole core 412 can also be threaded through at least some of the apertures (e.g., 718*a*-718*d* and 720*a*-720*d*) of the heel counter 710 and the heel portion 714 of the midsole carrier 410. In addition, the cable 107 can be threaded through the apertures 718*e* and 718*f*, through the apertures 720*e* and 720*f*, and through apertures in the upper (e.g., 302*a*) to affix the upper 104 to the sole 102.

Figure 8:
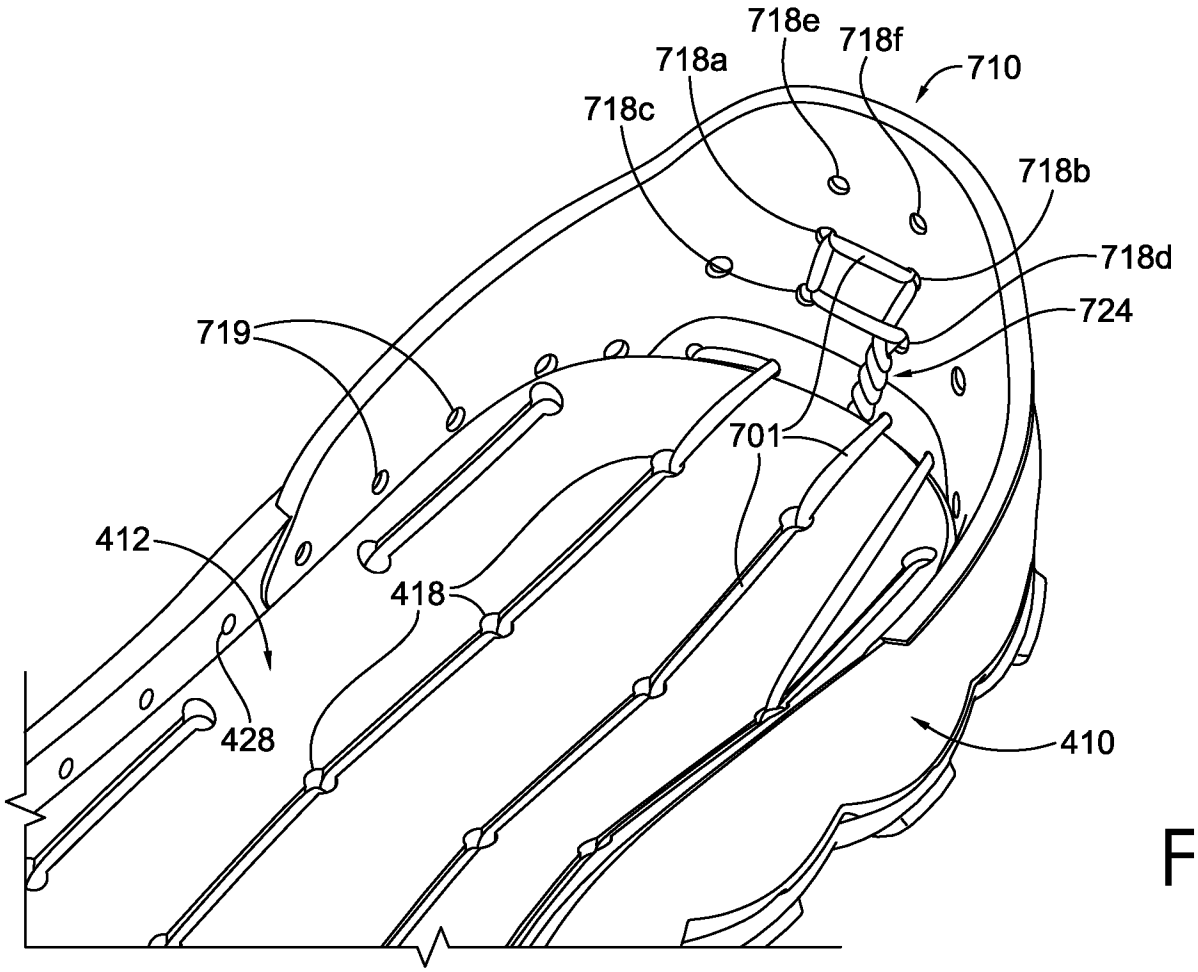
FIG. 8 depicts a heel counter attached to an article of footwear, in accordance with examples of this disclosure.

The heel counter 710 can include various other apertures as well. For example, the heel counter 710 can include apertures 719, which may be positioned to align with the sidewall apertures in the midsole carrier 410 (e.g., the sidewall apertures being obscured from view in FIG. 7). In some examples, the heel counter 710 can be affixed to the midsole carrier 410 before the midsole core 412 is placed into position (e.g., within the recess 446) to allow the apertures 719 to align with the sidewall apertures of the midsole carrier 410. For instance, in accordance with examples, FIG. 8 depicts the heel counter affixed in position and aligned with sidewall apertures (e.g., 428), which are obscured from view by the heel counter 710.

In examples, the heel counter 710 can compositionally comprise a first material and the midsole carrier 410 can compositionally comprise a second material, which is different from the first material. For example, in some instances, the first material can include a thermoplastic polyurethane or a thermoplastic polyethylene. In some examples, the midsole carrier 410 can include a foamed material (e.g., EVA foam). In some examples, the first material includes a first tear strength, and the second material comprises a second tear strength, which is lower than the first tear strength. As such, in some examples the heel counter 710 can reinforce the midsole carrier 410 (e.g., reinforce in association with the portion 714) and reduce the likelihood of the midsole carrier 410 tearing, such as when a cable is secured to the midsole carrier 410 under tension (e.g., when assembling and connecting the various parts of the sole 102). For example, referring to FIG. 8, another view is shown, depicting the heel counter 710 affixed, via the cable 701 to the midsole carrier 410, and in some examples, the cable 701 is the same as the cable 101 and is also threaded through other apertures in the midsole carrier 410 and the midsole core 412. In at least some instances, the cable 701 can be initially threaded through the apertures 718*a*-718*d* of the heel counter 710 and the apertures 720*a*-720*d* of the portion 714 and anchored into position (e.g., via a multi-twist cable structure 724), before then threading through the apertures in the recessed portion of the midsole carrier 410 and through the apertures 418 of the midsole core 412. In examples, the heel counter 710 with the higher tear strength allows for the combined structure of the heel counter 710 and the portion 714 to provide a robust mounting location to initially secure the cable 701 before moving on to thread through the other apertures of the midsole carrier 410 (e.g., apertures in the recessed portion) and midsole core 412. In at least some examples, once the heel counter 710 is affixed to the midsole carrier 410, the apertures 718*e* and 718*f* are configured to receive a cable (e.g., 107) for attaching the sole 102 to the upper 104.

In at least some examples, the midsole carrier 410 can be connected to a toe cap 712 (e.g., in FIG. 7 and similar to the toe cap 119 in FIGS. 1A and 1B). The toe cap 712 can, in some instances, help to reinforce the forefoot region (e.g., 108) of the midsole carrier 410. For example, midsole carrier 410 can include a toe portion 726 of the midsole carrier sidewall that forms an anterior, terminal wall of the sole and that wraps at least partially around the front end of the sole 102. The toe portion 726 can include an inner-facing surface and an outer-facing surface. In some examples, the toe cap 712 can be positioned adjacent the inner-facing surface of the toe portion 726. In some examples, the toe cap 712 can be positioned adjacent the outer-facing surface of the toe portion 726.

The toe cap 712 can include a series of apertures (e.g., 728*a* and 728*b*) that are alignable with apertures (e.g., 730*a* and 730*b*) in the toe portion 726 of the midsole carrier 410. In FIG. 7, example reference lines 732*a* and 732*b* are depicted to illustrate an example hole alignment between the toe cap 712 and the toe portion 726. In at least some examples, one or more cables can be threaded through the apertures (e.g., 728*a*, 728*b*, 730*a*, and 730*b*) to affix the toe cap 712 to the midsole carrier 410. For example, the cable 101 or 701 that attaches the midsole carrier 410 to the midsole core 412 can also be threaded through at least some of the apertures of the toe cap 712 and the toe portion 726. The toe cap 712 can include various other apertures as well. For example, the toe cap 712 can include apertures 729 and apertures 731. The apertures 729 and 731 can be configured to align with other parts of the footwear article (e.g., other parts of the sole 102 and/or other parts of the upper 104) for receiving one or more other cables for affixing the various components together. For example, apertures (e.g., 729) in the toe cap 712 may be positioned to align with apertures in a forefoot region of the upper 104. These apertures may receive a tensioning cable associated with a closure system (e.g., lacing system). In some examples, the tensioning cable associated with the closure system is a portion of the cable 107 for attaching the sole 102 to the upper 104.

In examples, the toe cap 712 can compositionally comprise a first material and the midsole carrier 410 can compositionally comprise a second material, which is different from the first material. For example, in some instances, the first material can include a thermoplastic polyurethane or a thermoplastic polyethylene. In some examples, the midsole carrier 410 can include a foamed material (e.g., EVA foam). In some examples, the first material includes a first tear strength, and the second material comprises a second tear strength, which is lower than the first tear strength. As such, in some examples the toe cap 712 can reinforce the midsole carrier 410 (e.g., reinforce in association with the toe portion 712) and reduce the likelihood of the midsole carrier 410 tearing, such as when a cable is secured to the midsole carrier 410 under tension (e.g., when assembling and connecting the various parts of the sole 102).

In at least some examples, the toe cap 712 provides an anchor point for the cable 101 or 701 at a directional transition of a path of the cable. For example, referring to FIG. 7, a cable path could generally work up the lateral side of the sole assembly in the direction indicated by the directional arrow 734 (e.g., as the cable is threaded in and out of the apertures in the midsole carrier 410 and the midsole core 412) or vice versa. Once the cable reaches the forefoot portion of the sole (e.g., near the toe portion 726), it might be desirable for the cable to then transition over to the medial side of the sole. In at least some examples, the toe cap 712 provides a robust structure for the cable to anchor to while also threadably moving from the lateral side to the medial side. For example, the cable could exit the aperture 736, pass into the apertures 730*a* and 728*a*, and threadably connect through the series of holes depicted in association with the toe cap 712 and the toe portion 726, before extending over to the medial side to then traverse towards the heel region of the sole. In examples, the toe cap 712 with the higher tear strength allows for the combined structure of the toe cap 712 and the toe portion 726 to provide a robust mounting location to secure the cable.

In at least some examples, once components of the sole assembly have been affixed via the one or more cables (e.g., including the heel counter 710 and the toe cap 712), the assembly can be affixed to an upper (e.g., the upper 104). For example, a cable (e.g., cable 107) can be threaded through a series of holes in the upper and various apertures associated with the midsole carrier 410, the heel counter 710, and the toe cap 712.

Example Cable(s) and Cable Threading for Articles of Footwear

Various apertures are described in association with the sole 102 and the upper 104, and as mentioned, in examples of the present disclosure, at least some of the apertures can threadably receive one or more cables for coupling parts of the article of footwear 100 together. The apertures can be configured to facilitate relatively straightforward cable threading, such as when assembling the article of footwear 100. For example, the apertures can be positioned in locations conducive to aperture alignment and to receiving a needle. In at least some examples, based on the assembly and part connection facilitated by the cable, the article of footwear may be easier to disassemble compared to a traditional article of footwear, which may improve recyclability. That is, a process of disassembling a conventional article of footwear may comprise several steps, such as separating glued-together elements (e.g., an upper and a sole), ripping out stitches, and/or removing adhesive-contaminated components. In contrast, components of the article of footwear 100 may be separated from one another simply by severing and/or removing the one or more cables.

In some examples, because the article of footwear's components may be attached to one another with cables, the article of footwear may be formed without (or substantially without) the use of an adhesive or other bonding methods (e.g., thermal bonding or fusion, ultrasonic welding, etc.). An adhesive-free construction may provide several benefits, including improved recyclability (since recyclable components will not be contaminated by an adhesive), decreased manufacturing time, decreased energy consumption during manufacturing (e.g., since some adhesives must be heated to improve bond strength), and environmental friendliness (e.g., due to a lack of potentially-toxic adhesives).

In some instances, the one or more cables may be formed from one or more recycled and/or recyclable materials (e.g., recycled polyester) while effectively replacing non-recyclable and/or environmentally unfriendly materials (e.g., adhesives and/or stitches).

In at least some examples, the one or more cables may comprise a higher tenacity, a greater thickness, and/or a greater durability than a material typically used to form a stitch in a traditional article of footwear. Thus, the cable may have a lower likelihood of tearing, snapping, or otherwise failing as compared to a stitch.

In one embodiment, the article of footwear may comprise three cables; in other embodiments, the article of footwear may comprise only one or two cables. In still other embodiments, the article of footwear may comprise more than three cables. A cable of the one or more cables may have the same or different properties compared to any other cable of the one or more cables. The one or more cables may include various types of cables, such as a braided cable, and can have various properties (e.g., diameter, compositional material, filament count, etc.). For example, the cables 101 and 107 can include a diameter in a range of about 1.0 mm to about 1.4 mm. In addition, the cables 101 and 107 can include a filament count of about 96 filaments. Further, the one or more cables may comprise polyester, such as recycled polyester, or other high-tenacity materials.

Various apertures are described in association with the sole 102 and the upper 104, which can be arranged to facilitate various threading steps or operations. For example, as described in association with the midsole carrier component 410, the apertures can include the apertures 416 associated with the recessed portion 446, as well as apertures 428 associated with the sidewall (e.g., sidewall apertures). In addition, the heel portion 714 of the midsole carrier component 410 can include the apertures 720*a*-720*d*, and the toe portion 726 of the midsole carrier component 410 can include the apertures 730*a*, 730*b*, and 736. In some examples, the apertures 720*a*-720*d*, 730*a*, 730*b*, and 736 can be a type of sidewall aperture that are characterized based on their relative locations. In addition, the apertures of the midsole carrier component 410 can be characterized based on a location on or along the medial side or the lateral side or a location more centrally located between the medial side and lateral side. In addition, as described, the midsole core component 412 can include the apertures 418, which can also be characterized based on a location on or along the medial side or the lateral side or a location more centrally located between the medial side and lateral side. Further, as described with respect to FIG. 3B, the upper 104 can include apertures 302*a*-302*e*, which can be characterized based on a location in the heel region or forefoot region, along the medial side or the lateral side, or a location more centrally located between the medial side and lateral side.

Figure 9A:
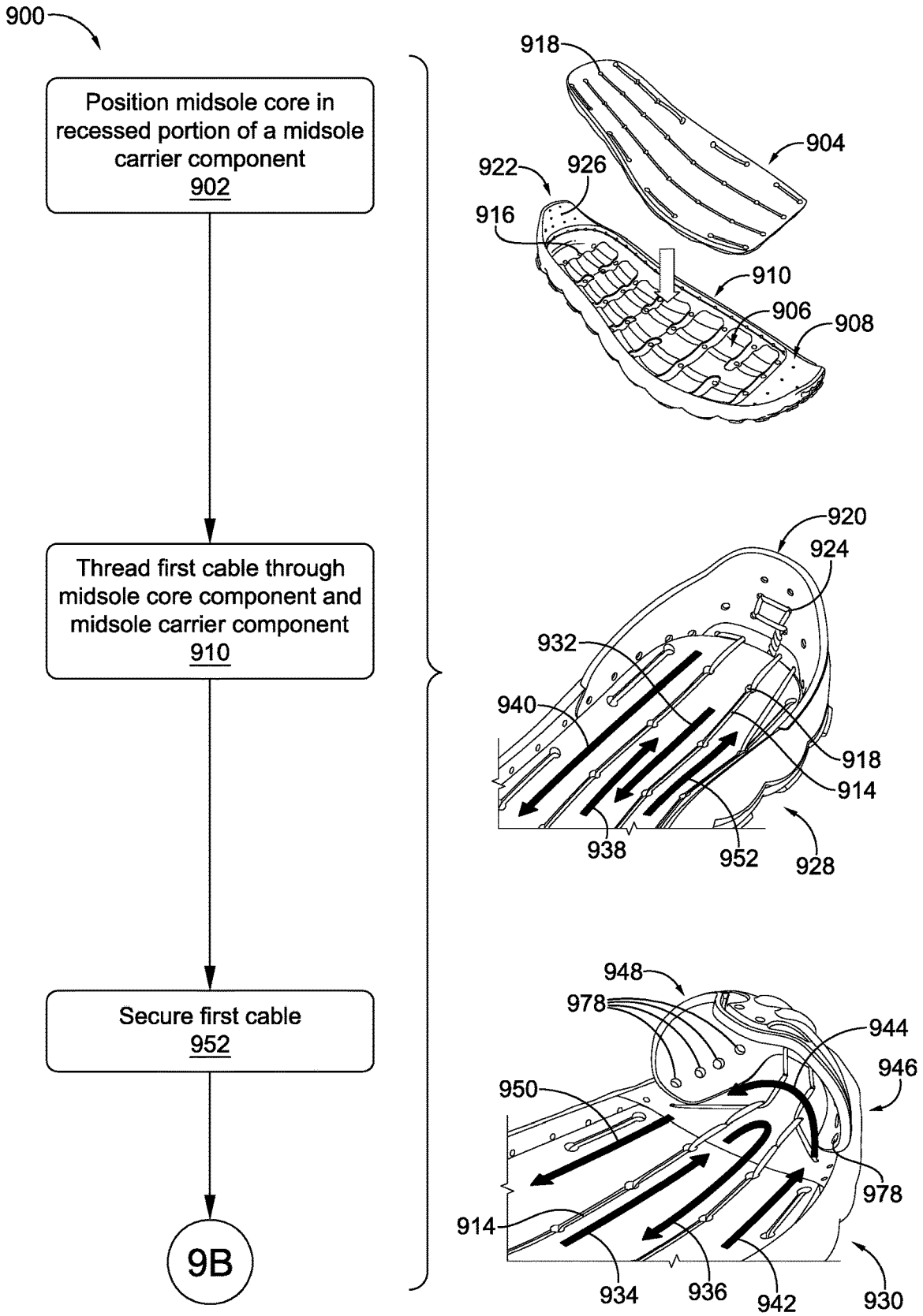
FIGS. 9A and 9B depict steps associated with a method of assembling a footwear article, in accordance with examples of this disclosure.
Figure 9B:
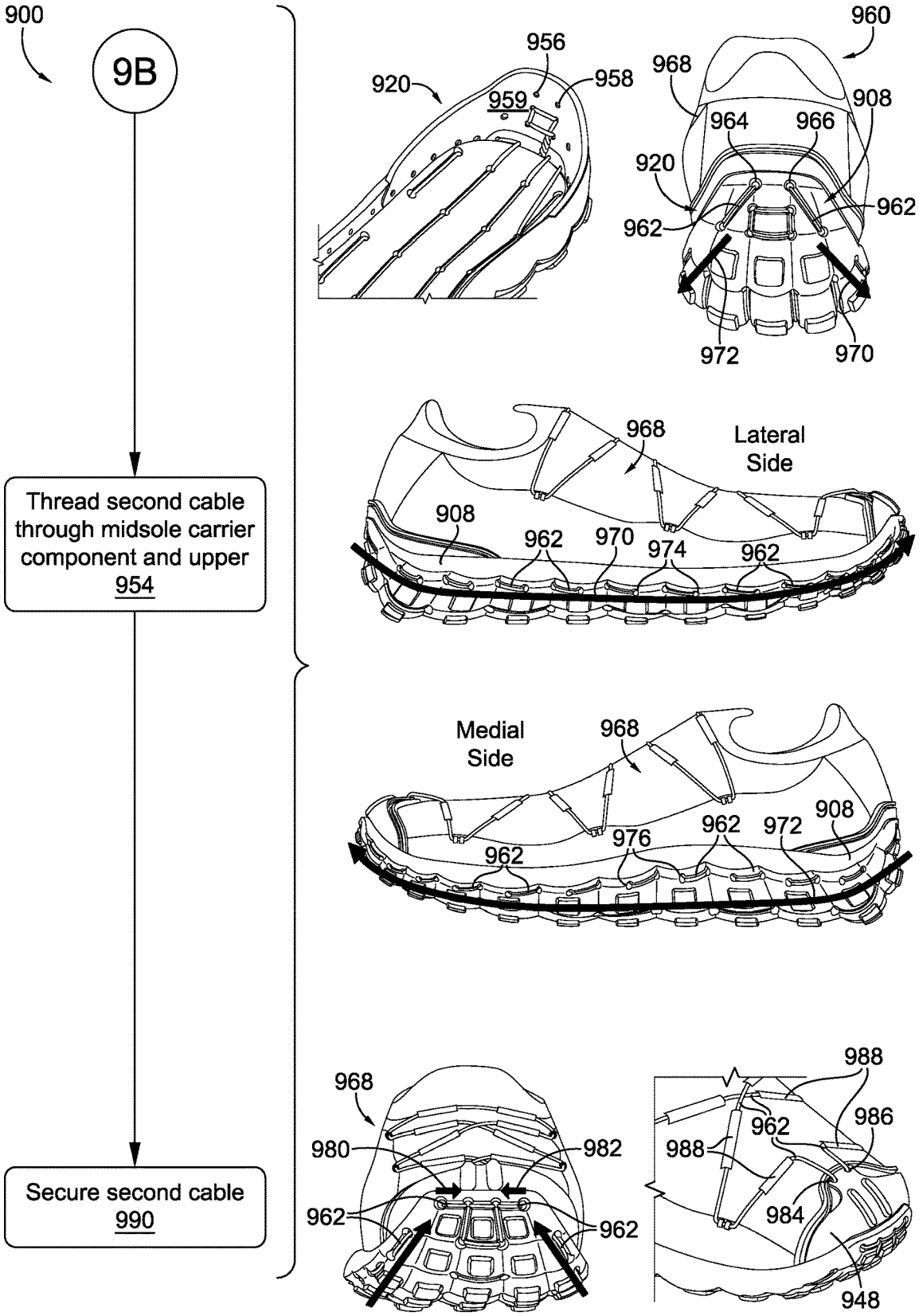

In examples, the operations for threading, via one or more cables, the various components together to assemble the article of footwear can include various steps. Referring to FIGS. 9A and 9B, a flow diagram is associated with operations for a method 900. In addition, FIGS. 9A and 9B include pictorials of subject matter that illustratively depict at least some operations associated with the method 900, in accordance with at least some examples. The pictorials are examples, and the method 900 is not limited to the example pictorials.

In examples, the method 900 includes, at 902, positioning a midsole core component in a recessed portion of a midsole carrier component. In addition, the midsole carrier component can include a sidewall forming a perimeter around the recessed portion. For example, FIG. 9A depicts a midsole core component 904 being positioned in a recessed portion 906 of a midsole carrier component 908, which includes a sidewall 910.

The method 900 can also include, at 912, threading a first cable through apertures in the recessed portion of the midsole carrier component and through apertures in the midsole core component. For example, FIG. 9A depicts a cable 914 threaded through apertures (e.g., 916) in the recessed portion 906 of the midsole carrier component 908 and through apertures (e.g., 918) of the midsole core component 904. In some examples, prior to positioning the midsole core component 904 in the recessed portion 906 (e.g., as part of operation 912), a heel counter 920 can be affixed to a heel portion 922 of midsole carrier component 908. For example, prior to threading the cable 914 through the apertures in the recessed portion 906 and through the apertures in the midsole core component 904, the cable 914 can be threaded through apertures (e.g., 924) in the heel counter 920 and through corresponding (e.g., aligned) apertures (e.g. 926) in the heel portion 922 of the midsole carrier component 908.

In examples, the apertures in the recessed portion and in the midsole core component can threadably receive the cable 914 in various orders or sequences. For example, in some instances, after being initially anchored to the heel counter 920 and the heel portion 922, the cable 914 can be threaded in a direction generally from the posterior or heel region (e.g., 928) of the sole to the anterior or forefoot region (e.g., 930) of the sole (e.g., as indicated by the directional arrows 932 and 934). In addition, in the anterior or forefoot region 930, the general direction of the threading operations can be switched, such that the cable 914 is generally threaded in a direction generally from the anterior or forefoot region 930 back to the posterior of heel region 928 (e.g., as indicated by the directional arrows 936 and 938). In some examples, the cable 914 can be threaded in a relatively linear path in the posterior-anterior orientation. In some examples, the cable 914 can include transverse segments that extend in the mediolateral orientation (e.g., as shown in the bottom view of FIG. 6A). For example, when a series of posterior-anterior segments are combined with a series of mediolateral segments, the segments of the cable 101 can form a shape (e.g., a square, a rectangle, or any other n-sided polygon). In some examples, the combination of posterior-anterior segments and mediolateral segments helps create friction points (e.g., based on the cable changing directions), which can help lock down the cable in a stable configuration to securely couple the midsole carrier to the midsole core. In at least some examples, when being threaded as indicated by the arrows 932, 934, 936, and 938, the cable 914 can be threaded primarily through apertures that are more centrally located and are less oriented to the medial or lateral sides.

In at least some examples, after being threaded in the direction indicated by the arrow 938, the general direction of the threading operations can be switched, such that the cable 914 is generally threaded in a direction generally from the posterior or forefoot region 928 back to the anterior or forefoot region 930 and along the medial or lateral side (e.g., as indicated by the directional arrows 940 and 942). In addition, in the forefoot region 930, the cable 914 can be threaded from one side of the forefoot region 930 (e.g., the lateral side) over to the other side of the forefoot region 930 (e.g., the medial side), as indicated by the directional arrow 944. In at least some examples, when transitioning the cable 914 from one side of the forefoot 930 to the other side of the forefoot 930, the cable 914 can be threaded through holes in the forefoot portion 946 of the midsole carrier component 908 (e.g., 736 in FIG. 7) and through apertures of the toe cap 948 (e.g., 730*a* and 730*b*). On the other side, the cable 914 can be threaded from the forefoot region 930 back to the heel region 928, as indicated by the directional arrows 950 and 952.

The method 900 can also include, at 954, securing the first cable to couple, without adhesive, the midsole carrier component to the midsole core component. In some examples, the cable 914 can be tied off or otherwise secured (e.g., after completing the pass associated with the arrow 952) to maintain a secure connection between the midsole carrier component 908, the midsole core component 904, the heel counter 920, and the toe cap 948. For example, the cable 914 can be threaded around one or more other segments of the cable (e.g., that have already been threaded through the apertures) to form a knot in the cable 914.

Once the cable 914 has been threaded among the various parts, the resulting footwear article (e.g., or sole) can have various features. For example, in some instances, the cable 914 can be considered an "underfoot" cable, based on the cable 914 extending beneath the foot-receiving cavity. Referring back to FIGS. 1A, 1B, 4, 5, 6A, 6B, and 7, at least some parts of the footwear article and/or sole can, in some examples, be constructed based on the method 900, in which case the cable 914 can be the same as, or similar to, the cable 101.

Referring to FIG. 9B, additional operations associated with the method 900 are depicted, according to some examples. For example, at 954, the method 900 can include threading a second cable through a first sidewall aperture in the sidewall of the midsole carrier component and through a first aperture in an upper of the article of footwear. For instance, as depicted by the pictorials associated with FIG. 9B, the heel counter 920 can include the apertures 956 and 958, which can be aligned with apertures in the heel portion sidewall of the midsole carrier component (e.g., apertures 720*e* and 720*f* in FIG. 7). As such, in some examples, an upper (e.g., the upper 104) can be positioned adjacent an inward-facing surface 959 of the heel counter 920, and a second cable can be threaded through the apertures of the upper (e.g., apertures 302*a* in the upper component 300*a*) and through the apertures 956 and 958 (and also through the aligned apertures of the midsole carrier component 908). As another example, FIG. 9B depicts a rear elevation view of the footwear article 960, after the second cable 962 is threadably received in the apertures 956 and 958 and in the apertures 964 and 966 of the midsole carrier component 908, and the upper 968 is secured to the midsole carrier component 908.

In at least some examples, after being threaded through a series of apertures associated with the upper 968, the heel counter 920, and the midsole carrier component 908, the second cable 962 can be threaded from the heel region and along the medial and lateral sides of the footwear article 960 and towards the forefoot. For example, as indicated by directional arrows 970 (e.g., lateral side) and 972 (e.g., medial side), opposing ends or segments of the second cable 962 can be threaded along respective sides of the footwear article 960, such as by passing in and out of apertures associated with the upper 968 (e.g., obscured from view in FIG. 9B and similar to the apertures 302*b* and 302*c*) and sidewall apertures associated with the midsole core component (e.g., 974 and 976).

FIG. 9B also depicts a front elevation view of the footwear article 960, as well as a portion of a perspective view of the forefoot. In at least some examples, after the second cable 962 has been threaded (in and out of apertures associated with the upper 968 and sidewall apertures) along the lateral and medial sides, the cable 962 can also be threaded through apertures associated with the toe cap 948. For example, referring back to the forefoot pictorial associated with FIG. 9A, the second cable 962 can be also threaded through apertures 978 (e.g., 731) associated with the toe cap 948 as the cable 962 is threaded along the medial and lateral sides. In some examples, these apertures 978 can align with at least some of the apertures (e.g., 302*d*) associated with the forefoot of the upper. In addition, referring to FIG. 9B, the portion of the second cable 962 on the lateral side can merge towards the portion of the cable on the medial side (e.g., while being threaded through the apertures 302*e* in the upper component 300*a*), such as indicated by the directional arrows 980 and 982. In at least some examples, after merging, the cable 962 can be threaded through tubular encasements of the upper 960 (e.g., FIG. 3A and tubular encasements 323) that are protected beneath the toe cap 948. In addition, after being threaded through the tubular encasements, the cable 962 can transition from threading through apertures 984 and 986 associated with the toe cap 948 to threading through tubular encasements 988 associated with the upper. As such, the cable 962 can transition from operating to coupling the upper to the sole to operating as a part of the closure mechanism associated with the upper (e.g., to adjust a fit of the upper).

Referring to the method 900, at 990, after the second cable 962 has been threaded through the sidewall apertures associated with the midsole carrier component and through the apertures associated with the upper, the second cable 962 can be secured to couple, without adhesive, the midsole carrier component to the upper. For example, the second cable can be secured by tying the second cable off, attaching hardware to the second cable (e.g., a clip, spring-loaded clasp, toggle, etc.), or a combination thereof.

Once the second cable has been threaded among the various parts, the resulting footwear article can have various features. For example, in some instances, the second cable 962 can be considered a "peripheral" cable, based on the second cable 962 extending around a periphery of the footwear article. Referring back to FIGS. 1A and 1B, at least some parts of the footwear article 100 can, in some examples, be constructed based on the method 900. As such, the peripheral cable 962, which can be similar to (or the same as) the cable 107, can extend through different regions of the article of footwear 100. For example, the cable 107 may be present in a heel region (e.g., the heel region 112) of the article of footwear 100 and may attach the upper 104, sole 102, and/or heel counter to one another in the heel region 112. In the heel region 112, upper apertures (e.g., apertures 302*a*), sidewall apertures (e.g., 720*e* and 720*f*), and apertures in the heel counter (e.g., apertures 718*e* and 718*f*) may correspond to one another (e.g., may align with one another), and the peripheral cable 107 may extend through the aligned apertures.

In addition to extending through various parts of the heel region 112, the cable 107 can extend along both the lateral side 114 and the medial side 116 and extend through the various sidewall apertures (e.g., 428) and apertures (e.g., 302*b* and 302*c*) associated with respective sides of the upper. That is, in some examples, the cable 107 can (e.g., in order to couple the upper 104 to the midsole carrier component 410) extend from the heel region 112, along both the lateral side 114 and the medial side 116, through the midfoot region 110, and into the forefoot region 108. In the forefoot region 108, the cable 107 can attach the upper 104, the sole 102, and/or the toe cap 712 to one another. For example, in the forefoot region 108, apertures (e.g., 302*d*) associated with the upper 104 can align with apertures (e.g., 731) associated with the toe cap 712 and with apertures associated with the midsole carrier component, and the peripheral cable 107 can extend through the aligned apertures. Further, in some examples, the cable 107 can exit apertures in the toe cap and, to form at least part of an enclosure system, extend among various tubular encasements (e.g., 120) and cable anchors (e.g., 124 and 126).

Figure 10:
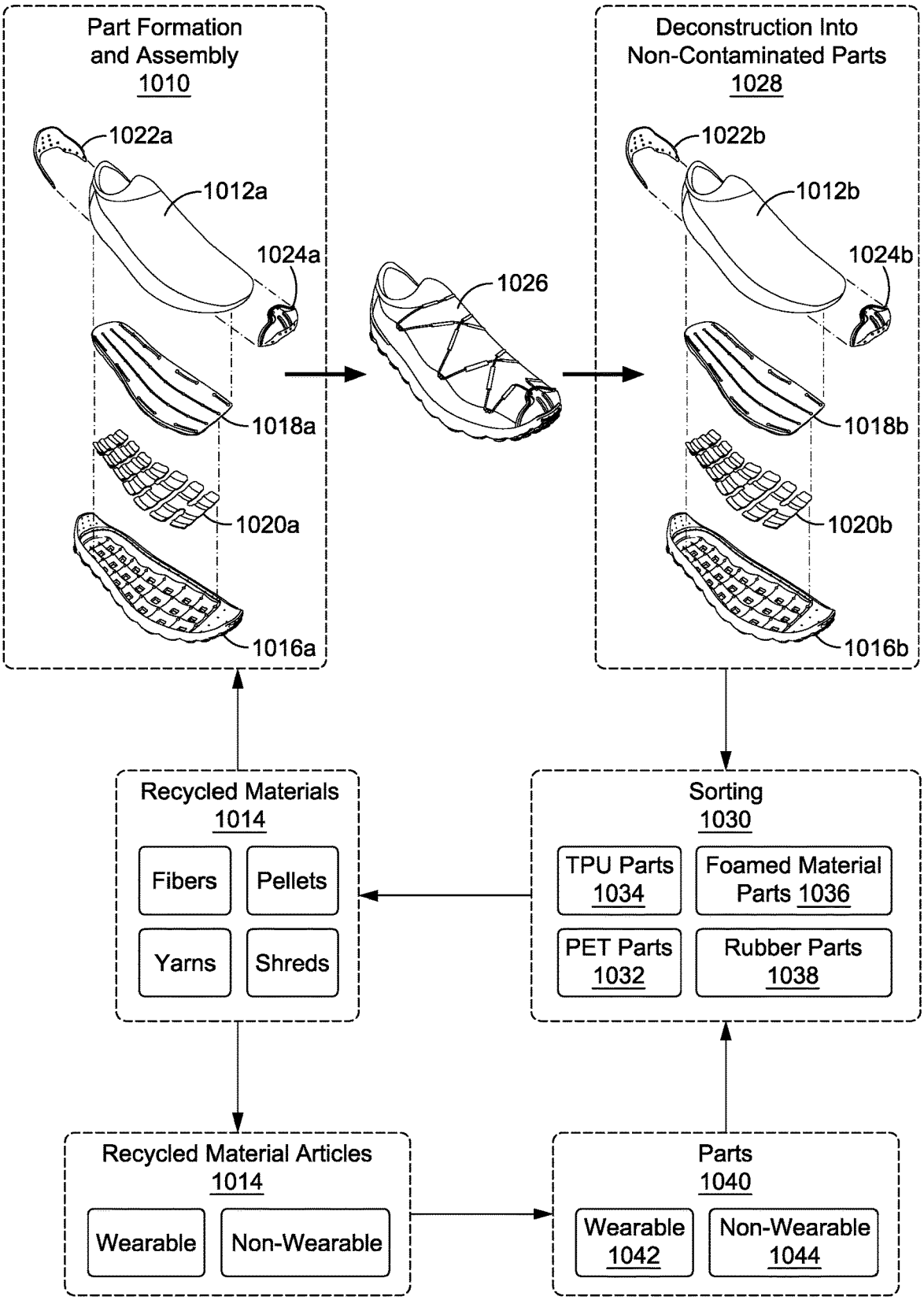
FIG. 10 depicts a diagram comprising various stages associated with lifecycles of footwear articles, in accordance with examples of this disclosure.

Examples of the present disclosure are associated with improved recyclability. For example, as explained, the use of a cable to assemble parts of the footwear article can improve the ability to deconstruct the footwear article into constituent parts that are free from contamination (e.g., free from residual chemicals or other materials from adhesives or from other parts). As such, some examples of the present disclosure are directed to systems and methods for recycling footwear articles. Referring to FIG. 10, a diagram depicts various stages associated with lifecycles of footwear articles.

In at least some examples, footwear articles can be associated with part formation and assembly 1010. For example, an upper 1012*a* (and the formation of the upper) can be associated with various operations. In at least some examples, materials for the upper can be prepared. In some instances, the materials can include raw materials. In at least some examples, the materials can include recycled materials 1014 derived from other footwear articles. For example, fibers can be formed or harvested, and in some instances, yarns for the upper 1012*a* can be formed (e.g., spun from fibers, extruded, etc.). Using fibers, yarns, and the like, the upper 1012*a* (e.g., or parts of the upper 1012*a*) can be formed by knitting, weaving, braiding, fiber entanglement (e.g., needling, hydroentangling, etc.), and the like. In at least some examples, the parts of the sole (e.g., midsole carrier 1016*a*, midsole core 1018*a*, outsole component(s) 1020*a*, etc.), the heel counter 1022*a*, and the toe cap 1024*a* are formed, such as by molding from pellets or other forms of raw materials (e.g., virgin and/or recycled) using known methods. In at least some examples, the various parts are assembled into a footwear article 1026, such as by using one or more cables (e.g., 101 and 107) described in other parts of this disclosure. In addition, the footwear article 1026 can be free (or substantially free) from at least some other types of part bonding structures, such as chemical adhesives, thermal bonding structures, and the like.

In at least some examples, footwear articles of the present disclosure can be associated with deconstruction into non-contaminated parts 1028. That is, by simply removing (e.g., unthreading and/or cutting) the cables 101 and 107, the various parts 1012*a*, 1016*a*, 1018*a*, 1020*a*, 1022*a*, and 1024*a* that were assembled into the footwear article 1026 can be disassembled into constituent parts 1012*b*, 1016*b*, 1018*b*, 1020*b*, 1022*b*, and 1024*b* that are not contaminated by residual materials, including chemical adhesive and/or fragments broken away from other parts. In contrast, conventional solutions typically include bonding methods that result in part contamination. For example, an upper and sole can sometimes be decoupled, but under conventional approaches, the parts often include residual adhesive and/or fragments of the other part that have broken off.

In at least some examples, the footwear article 1026 (and/or the footwear article 100) can include some bonding structures (e.g., chemical adhesive, thermal bonding structure, etc.) other than the cables and still be deconstructable into parts in such a manner as to be conducive to recycling. For example, the footwear article 1026 can include a relatively small amount of chemical adhesive between two or more parts and still be substantially free of (or substantially without) chemical adhesives, such that the footwear article 1026 can still be deconstructed into constituent parts, which can be recycled. In some instances, the footwear article 1026 can be deconstructed (e.g., by removing the cable(s)), and two or more parts can still be bonded (e.g., via chemical adhesive, thermal bonding structures, etc.). In at least some examples, the bonded potions of the parts can be removed or extracted (e.g., by cutting away) to separate the bonded parts into constituent parts which are free from adhesive and particulates/fragments of the other bonded part and which can now be recycled. In some examples, the footwear article 1026 can be substantially free from non-cable connections (e.g., chemical adhesive, thermal bonding structures, etc.) where the removed portion (e.g., that is cut away) comprises 5% or less by weight of the footwear article 1026 (e.g., prior to removal). In other examples, a footwear article can be substantially free from bonding structures (e.g., chemical adhesive, thermal bonding structures, etc.) where the removed portion comprises less than 1% or less than 0.1% by weight of the article of footwear. In some examples, a constituent part can be substantially free from bonding structures (e.g., chemical adhesive, thermal bonding structures, etc.) where the removed portion comprises less than 5%, less than 1%, or less than 0.1% by weight of an entirety of the component (e.g., an upper, sole, toe cap, or heel counter) from which the removed portion is extracted. The removed or extracted portion can be a portion of any component (or combination of components) of the article of footwear; likewise, the article of footwear may comprise more than one removed or extracted portion.

In some examples, once a footwear article is deconstructed into parts 1012*b*, 1016*b*, 1018*b*, 1020*b*, 1022*b*, and 1024*b*, the parts can be sorted 1030 by material type. For example, the upper 1012*b* can be sorted into a category associated with material forming fibers of the upper 1012*b*. That is, if fibers of the upper 1012*b* compositionally comprise polyester (PET) or recycled PET (PET), then the upper 1012*b* can be sorted into a group of parts all containing PET or rPET (e.g., PET parts 1032). In some examples, the heel counter 1022*b* and the toe cap 1024*b* can compositionally comprise TPU, and those parts can be sorted into a group of parts all containing TPU (e.g., TPU parts 1034). In some examples, the midsole carrier 1016*b* and the midsole core 1018*b* compositionally comprise a foamed material (e.g., foamed EVA), and those parts can be sorted into a group of parts all containing foamed EVA or similar materials (e.g., foamed materials parts 1036). In some examples, the outsole components 1020*b* compositionally comprise rubber, and those parts can be sorted into a group of parts all containing rubber or similar materials (e.g., rubber parts 1038).

In examples, sorting 1030 by material type can including grouping or compiling with a variety of parts and products 1040. For example, sorting 1030 can include grouping with other wearable 1042 parts and products, such as other footwear uppers, footwear cables or laces, upper-body garments, lower-body garments, headwear, gloves, and the like.

In addition, sorting 1030 can include grouping with non-wearable 1044 parts and products such as bags (e.g., backpacks, duffel bags, etc.), roll goods (e.g., textiles on rolls), textile remnants (e.g., remnants left over after pattern pieces are cut out) or other industrial waste, and goods from other industries (e.g., PET containers, carpets, furnishings, etc.).

In examples of the present disclosure, based at least in part on the cable-based construction of the footwear article 1026, at least some of the parts 1032, 1034, 1036, and 1038 include relatively low contamination from other materials and can be converted into materials 1014 for manufacturing additional articles, including the recycled material articles 1046. For example, parts 1032, 1034, 1036, and 1038 can be re-molten and pelletized. Pelletized materials can then be used to form recycled fibers, recycled polymer molded parts, recycled foamed material foamed parts, and the like. In at least some examples, at least some of the parts 1032, 1034, 1036, and 1038 can be shredded for use in fill materials, composites, etc. In at least some examples, fibers can be formed, such as by extruding filaments or spinning fibers. Again, these various materials, including fibers, pellets, shreds, yarns, etc. can be relatively free from contaminants, based in part on the cable assembly and ability to deconstruct the footwear article 1026 with relatively low part contamination.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. An article of footwear comprising: a sole; an upper comprising an underfoot portion that at least partially encloses a foot-receiving cavity; and the underfoot portion comprising a spacer-knit textile that is positioned between the foot-receiving cavity and one or more cables, which couple together components of the article of footwear.

Clause 2. The article of footwear of clause 1, wherein: the sole comprises one or more components coupled together via a first cable of the one or more cables; and the spacer-knit textile is positioned between the foot-receiving cavity and the first cable.

Clause 3. The article of footwear of any of clauses 1-2 further comprising, a second cable of the one or more cables that couples, around a periphery of the underfoot portion, the upper to the sole.

Clause 4. The article of footwear of any of clauses 1-3 further comprising: a heel counter; a toe cap; and the first cable and the second cable threaded through the heel counter and the toe cap.

Clause 5. The article of footwear of any of clauses 1-4, wherein the second cable comprises a portion of a closure mechanism associated with the article of footwear.

Clause 6. The article of footwear of any of clauses 1-5 further comprising, tubular encasements associated with a vamp of the upper, wherein the second cable extends through the tubular encasements.

Clause 7. The article of footwear of any of clauses 1-6, wherein: the one or more components of the sole are coupled together via the first cable and without chemical adhesive; and the upper is coupled to the sole via the second cable and without chemical adhesives.

Clause 8. The article of footwear of clauses 1-7, wherein: the sole comprises an outer-facing surface that comprises a groove; and at least a portion of the second cable is positioned in the groove.

Clause 9. The article of footwear of any of clauses 1-8, wherein: the spacer-knit textile comprises a first knit layer, a second knit layer, and a plurality of tie yarns in an interstitial space between the first knit layer and the second knit layer; the first knit layer is positioned closer to the sole than the second knit layer; and a cable of the one or more cables extends through the first knit layer and into the interstitial space.

Clause 10. The article of footwear of any of clauses 1-9, wherein a cable of the one or more cables is about 1.2 mm in diameter.

Clause 11. The article of footwear of any of clauses 1-10, wherein the upper further comprises: a medial portion and a lateral portion that are integrally knit with the underfoot portion; a plurality of apertures that are integrally knit with the upper and that threadably receive a cable of the one or more cables; and a vamp portion comprising a plurality of tubular encasements that are integrally knit with the vamp portion and that threadably receive the cable of the one or more cables.

Clause 12. An article of footwear comprising: a sole; an upper comprising a lower peripheral margin, wherein the lower peripheral margin overlaps with the sole; and a cable that is threaded through the lower peripheral margin and through the sole to couple the upper to the sole, wherein the cable comprises at least a portion of a lacing system associated with the article of footwear.

Clause 13. The article of footwear of clause 12 further comprising, a heel counter, wherein the cable is threaded through the heel counter and couples the heel counter to the upper.

Clause 14. The article of footwear of any of clauses 12-13 further comprising, a toe cap, wherein the cable is threaded through the toe cap and couples the toe cap to the upper.

Clause 15. The article of footwear of any of clauses 12-14 further comprising, a spacer-knit textile that is integrally knit with the lower peripheral margin and that comprises an underfoot portion of the article of footwear.

Clause 16. The article of footwear of any of clauses 12-15, wherein: the spacer-knit textile comprises a first knit layer, a second knit layer, and a plurality of tie yarns in an interstitial space between the first knit layer and the second knit layer; the first knit layer is positioned closer to the sole than the second knit layer; and the cable extends through the first knit layer and into the interstitial space.

Clause 17. The article of footwear of any of clauses 12-16, wherein the upper is coupled to the sole via the cable and without chemical adhesives or thermal bonding structures.

Clause 18. The article of footwear of any of clauses 12-17, wherein the cable passes through a plurality of tubular encasements positioned on an outward-facing surface of the upper.

Clause 19. An article of footwear comprising: a sole; an upper comprising a portion that overlaps with the sole; a heel counter positioned between the portion of the upper and the sole; a toe cap positioned between the portion of the upper and the sole; and a cable that is threaded through the portion of the upper, the heel counter, the sole, and the toe cap.

Clause 20. The article of footwear of clause 19, wherein the sole comprises a sidewall, wherein the portion of the upper overlaps with the sidewall, wherein the heel counter is positioned between the portion of the upper and the sidewall, and wherein the toe cap is positioned between the portion of the upper and the sidewall.

Clause 21. The article of footwear of any of clauses 19-20, wherein the heel counter comprises a higher tear strength than the sole, and wherein the toe cap comprises a higher tear strength than the sole.

Clause 22. The article of footwear of any of clauses 19-21, wherein the sole comprises ethylene-vinyl acetate (EVA) foam and the heel counter and the toe cap comprise thermoplastic polyurethane (TPU).

Clause 23. The article of footwear of any of clauses 19-22, wherein: the sole comprises a plurality of components; the plurality of components of the sole are coupled via a second cable; and the second cable is threaded through the heel counter and the toe cap.

Clause 24. The article of footwear of any of clauses 19-23, wherein: the upper at least partially encloses a foot-receiving cavity; and the upper comprises a spacer-knit textile that is integrally knit with the portion of the upper overlapping the sidewall and that is positioned between the second cable and the foot-receiving cavity.

Clause 25. The article of footwear of any of clauses 19-24, wherein: the upper further comprises a vamp comprising a plurality of tubular encasements; and the cable is threaded through the plurality of tubular encasements and comprises at least part of a lacing system configured to adjust a fit of the upper.

Clause 26. The article of footwear of any of clauses 19-25, wherein the upper is coupled to the sole, the heel counter, and the toe cap via the cable and without chemical adhesives or thermal bonding structures.

Clause 27. An article of footwear comprising: a sole comprising one or more components coupled together via a first cable; an upper comprising a vamp and an underfoot portion that at least partially enclose a foot-receiving cavity, wherein: the vamp comprises a plurality of tubular encasements; and the underfoot portion comprising a spacer-knit textile that is positioned between the foot-receiving cavity and the first cable; a heel counter positioned between the upper and the sole; a toe cap positioned between the upper and the sole; and a second cable that extends through, and couples, the upper, the heel counter, the sole, and the toe cap, wherein the second cable extends through the tubular encasements and comprises at least a portion of a lacing system associated with the article of footwear.

Clause 28. The article of footwear of clause 27, wherein: the spacer-knit textile comprises a first knit layer, a second knit layer, and a plurality of tie yarns in an interstitial space between the first knit layer and the second knit layer; the first knit layer is positioned closer to the sole than the second knit layer; and the second cable extends through the first knit layer and into the interstitial space.

Clause 29. The article of footwear of any of clauses 27-28, wherein the sole comprises ethylene-vinyl acetate (EVA) foam and the heel counter and the toe cap comprise thermoplastic polyurethane (TPU).

Clause 30. The article of footwear of any of clauses 27-29, wherein the upper is coupled to the sole, the heel counter, and the toe cap via the second cable and without chemical adhesives or thermal bonding structures.

Clause 31. An article of footwear comprising: an upper comprising a medial portion, a lateral portion, and an underfoot portion; a sole comprising a midsole carrier component, a midsole core component, and one or more outsole components positioned between the midsole carrier component and the midsole core component and extending through the midsole carrier component to form a ground-contacting element; a first cable that is threaded through the upper and the midsole carrier component and that couples the upper to the sole; and a second cable that is threaded through the midsole carrier component and the midsole core component and that couples the midsole carrier component to the midsole core component.

Clause 32. The article of footwear of clause 31 further comprising, a heel counter that is arranged between a heel portion of the midsole carrier component and a heel portion of the upper, wherein the first cable and the second cable are threaded through the heel counter and couple, without chemical adhesive or thermal bonding structures, the heel counter to the upper and to the midsole carrier component.

Clause 33. The article of footwear of any of clauses 31-32 further comprising, a toe cap that is arranged between a forefoot portion of the midsole carrier component and a forefoot portion of the upper, wherein the first cable and the second cable couple, without chemical adhesive or thermal bonding structures, the toe cap to the upper and to the midsole carrier component.

Clause 34. The article of footwear of any of clauses 31-33, wherein: the upper comprises tubular encasements that are arranged on a dorsal portion of the upper and that are integrally knit with the upper; and the first cable is threaded through the tubular encasements and comprises at least part of a closure mechanism associated with the article of footwear.

Clause 35. The article of footwear of any of clauses 31-34, wherein: the one or more outsole components comprise a traction lug positioned in a through hole of the midsole carrier component; and the one or more outsole components are secured between the midsole carrier component and the midsole core component via the second cable and without chemical adhesive or thermal bonding structures.

Clause 36. The article of footwear of any of clauses 31-35, wherein: the upper at least partially encloses a foot-receiving cavity; the midsole core component comprises a superior surface facing towards the foot-receiving cavity, at least a portion of the second cable extending along the superior surface; and the underfoot portion comprises a spacer knit textile that covers the superior surface and the second cable and that is secured in position via the first cable.

Clause 37. The article of footwear of any of clauses 31-36, wherein the upper is coupled to the sole without chemical adhesive or thermal bonding structure, and wherein the midsole carrier component is coupled to the midsole core component without chemical adhesive or thermal bonding structure.

Clause 38. A method of manufacturing an article of footwear, the method comprising: positioning a midsole core component in a recessed portion of a midsole carrier component, wherein the midsole carrier component comprises a sidewall forming a perimeter around the recessed portion; threading a first cable through apertures in the recessed portion of the midsole carrier component and through apertures in the midsole core component; and securing the first cable to couple the midsole carrier component to the midsole core component.

Clause 39. The method of clause 38, wherein the method further comprises: threading a second cable through a first sidewall aperture in the sidewall of the midsole carrier component and through a first aperture in an upper of the article of footwear; and securing the second cable to couple the midsole carrier component to the upper.

Clause 40. The method of any of clauses 38-39, wherein the midsole carrier component is coupled to the midsole core component without adhesive, and wherein the midsole carrier component is secured to the upper without adhesive.

Clause 41. The method of any of clauses 38-40, wherein: the sidewall includes a heel portion comprising a second sidewall aperture; and the method further comprises: positioning a heel counter adjacent to the heel portion; threading the first cable through the heel counter and through the second sidewall aperture; and threading the second cable through the heel counter and through a second aperture in the upper.

Clause 42. The method of any of clauses 38-41, wherein the first cable is threaded through the second sidewall aperture before being threaded through the apertures in the recessed portion.

Clause 43. The method of any of clauses 38-42, wherein: the sidewall includes a forefoot portion comprising a third sidewall aperture; and the method further comprises: positioning a toe cap adjacent to the forefoot portion; threading the first cable through the toe cap and through the third sidewall aperture; and threading the second cable through the toe cap and through a third aperture in the upper.

Clause 44. The method of any of clauses 38-43 further comprising, after threading the second cable through the toe cap and through the third aperture in the upper, threading the second cable through tubular encasements in a vamp portion of the upper.

Clause 45. The method of any of clauses 38-44, wherein: the apertures in the recessed portion include apertures on a medial side of the midsole carrier component and apertures on a lateral side of the midsole carrier component; the first cable is threaded through either the apertures on the medial side of the midsole carrier component or through apertures on the lateral side of the midsole carrier component before being threaded through the toe cap; and the first cable is threaded through the other of the apertures on the medial side of the midsole carrier component or through apertures on the lateral side of the midsole carrier component after being threaded through the toe cap.

Clause 46. The method of any of clauses 38-45 further comprising: before positioning the midsole core component in the recessed portion, positioning an outsole component in the recessed portion of the midsole carrier component; and inserting a traction lug of the outsole component into a through hole of the midsole carrier component, the traction lug protruding beyond a ground-facing surface of the midsole carrier component.

Clause 47. A method of recycling an article of footwear, the method comprising: removing a cable from the article of footwear, wherein: removal of the cable decouples an upper of the article of footwear from a sole component of the article of footwear; and the upper compositionally comprises a first material and the sole component compositionally comprises a second material, which is different from the first material and comprises a foamed material; compiling the upper with a first article compositionally comprising the first material; generating, from the upper and the first article, yarns comprising the first material; compiling the sole component with a second article compositionally comprising the second material; and generating, from the sole component and the second article, a recycled foam material.

Clause 48. The method of clause 47, wherein: the sole component, when assembled in the article of footwear, is secured via a second cable to a second sole component; the method further comprises removing the second cable from the sole component and the second sole component; and removal of the second cable decouples the sole component from the second sole component.

Clause 49. The method of any of clauses 47-48, wherein the second sole component comprises the second article.

Clause 50. The method of any of clauses 47-49, wherein the second sole component comprises a third material, which is different from the first material and is different from the second material.

Clause 51. The method of any of clauses 47-50, wherein: the second sole component comprises a heel counter or a toe cap; and the third material comprises thermoplastic polyurethane (TPU).

Clause 52. The method of any of clauses 47-51, wherein the third material comprises rubber.

Clause 53. The method of any of clauses 47-52, wherein: the sole component is a midsole component comprising a through hole; the article of footwear comprises an outsole component that includes a traction lug, which is frictionally engaged without adhesive in the through hole; the method further comprises removing the traction lug from the through hole; and removal of the traction lug from the through hole decouples the outsole component from the midsole component.

Clause 54. A method of manufacturing an article of footwear, the method comprising: threading a first cable through a plurality of sidewall apertures in a sidewall of a midsole carrier component and through a plurality of apertures in an upper of the article of footwear; and securing the first cable to couple the midsole carrier component to the upper.

Clause 55. The method of clause 54, wherein the method further comprises: positioning a midsole core component in a recessed portion of the midsole carrier component, wherein the sidewall forms a perimeter around the recessed portion; threading a second cable through apertures in the recessed portion of the midsole carrier component and through apertures in the midsole core component; and securing the second cable to couple the midsole carrier component to the midsole core component.

Clause 56. A method comprising: obtaining a first shoe component comprising a first material; obtaining a second shoe component comprising a second material different than the first material; recycling the first shoe component using a first process; and recycling the second shoe component using a second process different than the first process.

Clause 57. The method of clause 56, wherein the first shoe component comprises an upper.

Clause 58. The method of any of clauses 56-57, wherein the second shoe component comprises a component of a sole.

Clause 59. The method of any of clauses 56-58, wherein the first process comprises shredding, re-pelletization, or a combination thereof.

Clause 60. The method of any of clauses 56-59, wherein the second process comprises shredding, grinding, re-pelletization, or a combination thereof.

Clause 61. The method of any of clauses 56-60, wherein the method further comprises harvesting the first shoe component free of contamination by a material other than the first material.

Clause 62. The method of any of clauses 56-61, wherein the method further comprises harvesting the second shoe component free of contamination by a material other than the second material.

Clause 63. A footwear article comprising: an upper at least partially enclosing a foot-receiving cavity; a sole coupled to the upper; and the sole comprising: a midsole carrier component comprising: a superior surface facing towards the foot-receiving cavity; an inferior surface facing away from the foot-receiving cavity; a midsole stratum between the superior surface and the inferior surface; and a through hole extending from the superior surface, through the midsole stratum, to the inferior surface; an outsole component having portion positioned adjacent the superior surface and comprising a traction lug positioned in the through hole and protruding away from the foot-receiving cavity and beyond the inferior surface; a midsole core component adjacent the portion of the outsole component and the superior surface, the portion of the outsole component being positioned between the superior surface and the midsole core component; and a cable extending through, and attaching, at least the midsole carrier component and the midsole core component.

Clause 64. The footwear article of clause 63 further comprising: a toe cap and a heel counter that are affixed, via the cable, to the midsole carrier component.

Clause 65. The footwear article of any of clauses 63-64, wherein the midsole carrier component comprises: a first cable-receiving through hole; a second cable-receiving through hole; and a groove that is in the inferior surface and that connects the first cable-receiving through hole to the second cable-receiving through hole, wherein the cable passes, in the groove, from the first cable-receiving through hole to the second-cable receiving through hole.

Clause 66. The footwear article of any of clauses 63-65, wherein the midsole core component comprises: a first cable-receiving through hole; a second cable-receiving through hole; a second superior surface that faces towards the foot-receiving cavity; and a groove that is in the second superior surface and that connects the first cable-receiving through hole to the second cable-receiving through hole, wherein the cable passes, in the groove, from the first cable-receiving through hole to the second-cable receiving through hole.

Clause 67. The footwear article of any of clauses 63-66, wherein: the through hole comprises a first width; and the traction lug comprises a second width, which is larger than the first width.

Clause 68. The footwear article of any of clauses 63-67, wherein: the superior surface comprises a recess; and the midsole core component nests in the recess.

Clause 69. The footwear article of any of clauses 63-68, wherein the midsole carrier component and the midsole core component are coupled to one another via the cable and without any chemical adhesive or thermal bonding structure.

Clause 70. The footwear article of any of clauses 63-69, wherein the upper is coupled to the sole via a second cable and without any chemical adhesive or thermal bonding structure.

Clause 71. A footwear article comprising: an upper at least partially enclosing a foot-receiving cavity; a sole comprising: a midsole carrier component comprising a superior surface, which faces towards the foot-receiving cavity, and a through hole; an outsole component positioned between the superior surface and the foot-receiving cavity and comprising a traction lug positioned in the through hole; a midsole core component arranged between the outsole component and the foot-receiving cavity; and a cable extending through, and attaching, at least the midsole core component and the midsole carrier component.

Clause 72. The footwear article of clause 71 further comprising a toe cap affixed, via the cable, to the midsole carrier component.

Clause 73. The footwear article of any of clauses 71-72 further comprising a heel counter affixed, via the cable, to the midsole carrier component.

Clause 74. The footwear article of any of clauses 71-73, wherein the midsole carrier component comprises: an inferior surface that faces away from the foot-receiving cavity; a groove in the inferior surface; and the cable positioned in the groove.

Clause 75. The footwear article of any of clauses 71-74, wherein the midsole core component comprises: a second superior surface that faces towards the foot-receiving cavity; a groove in the superior surface; and the cable positioned in the groove.

Clause 76. The footwear article of any of clauses 71-75, wherein: the through hole comprises a first width; the traction lug comprises a perimeter rib; and the perimeter rib comprises a second width, which is larger than the first width.

Clause 77. The footwear article of any of clauses 71-76, wherein: the superior surface comprises a recess; and the midsole core component nests in the recess.

Clause 78. The footwear article of any of clauses 71-77 further comprising, a toe cap and a heel counter coupled, via the cable, to the midsole carrier component, wherein: the midsole carrier component and the midsole core component comprise a foamed material; the toe cap and the heel counter comprise a thermoplastic polymer; the outsole component comprises a rubber; and the cable attaches, without an adhesive, the midsole carrier component to the toe cap, the heel counter, the midsole core component, and the outsole component.

Clause 79. The footwear article of any of clauses 71-78, wherein: the superior surface comprises a concave portion; the through hole is positioned in a bottom of the concave portion; and the outsole component comprises, around the traction lug, a convex portion corresponding with a contour of the concave portion.

Clause 80. A method comprising: positioning, adjacent to a superior surface of a midsole carrier component, an outsole component that comprises a traction lug; inserting, through a through hole of the midsole carrier component, the traction lug, wherein the traction lug protrudes beyond an inferior surface of the midsole carrier component; stacking a midsole core component atop the outsole component, such that the outsole component is positioned between the midsole carrier component and the midsole core component; and threading a cable through a first set of through holes in the midsole core component and a second set of through holes in the midsole carrier component.

Clause 81. The method of clause 80 further comprising: positioning the cable in a first groove, which is positioned on a superior surface of the midsole core component and connects a first and a second through hole of the first set of through holes; and positioning the cable in a second groove, which is positioned on an inferior surface of the midsole carrier component and connects a first and a second through hole of the second set of through holes.

Clause 82. The method of any of clauses 80-81 further comprising, attaching the midsole carrier component to the midsole core component with only the cable and without any chemical adhesive or thermal bonding structure.

Clause 83. A footwear article comprising: an upper at least partially enclosing a foot-receiving cavity; a sole comprising: a midsole carrier component comprising a superior surface, which faces towards the foot-receiving cavity, and a through hole; and an outsole component positioned between the superior surface and the foot-receiving cavity and comprising a traction lug interlocked in the through hole; and a cable extending through, and securing, the midsole carrier component to one or more other components of the footwear article.

Clause 84. The footwear article of clause 83, wherein: the through hole comprises a first width; the traction lug comprises a perimeter rib; and the traction lug comprises, at a portion associated with the perimeter rib, a second width, which is larger than the first width.

Clause 85. The footwear article of any of clauses 83-84, wherein: the superior surface comprises a concave portion; the through hole is positioned in a bottom of the concave portion; and the outsole component comprises, around the traction lug, a convex portion corresponding with a contour of the concave portion.

Clause 86. The footwear article of any of clauses 83-85, wherein the cable secures the midsole carrier component to the outsole component.

Clause 87. The footwear article of any of clauses 83-86, wherein the midsole carrier component is secured to the outsole component without any chemical adhesive or thermal bonding structure.

Clause 88. The footwear article of any of clauses 83-87 further comprising a toe cap affixed, via the cable, to the midsole carrier component.

Clause 89. The footwear article of any of clauses 83-88 further comprising a heel counter affixed, via the cable, to the midsole carrier component.

Clause 90. A footwear article comprising: an upper at least partially enclosing a foot-receiving cavity; a sole comprising: a midsole carrier component comprising a superior surface, which faces towards the foot-receiving cavity; a midsole core component arranged between the superior surface of the midsole carrier component and the foot-receiving cavity; and a cable extending through, and attaching, at least the midsole core component and the midsole carrier component.

Clause 91. The footwear article of clause 90, wherein the midsole core component comprises: a second superior surface that faces towards the foot-receiving cavity; a groove in the superior surface; and the cable positioned in the groove.

Clause 92. The footwear article of any of clauses 90-91, wherein: the superior surface comprises a recess; and the midsole core component nests in the recess.

Clause 93. The footwear article of any of clauses 90-92 further comprising, a toe cap and a heel counter coupled, via the cable, to the midsole carrier component, wherein: the midsole carrier component and the midsole core component comprise a foamed material; the toe cap and the heel counter comprise a thermoplastic polymer; and the cable attaches, without an adhesive, the midsole carrier component to the toe cap, the heel counter, and the midsole core component.

Clause 94. The article of footwear of any of clauses 1-11, wherein: the spacer-knit textile comprises a first thickness at a first location at an intersection of a longitudinal midline of the article of footwear and a lateral midline of the article of footwear; the spacer-knit textile comprises a second thickness at a second location that is on the longitudinal midline and that is closer to a toe portion of the article of footwear than the first location; and the first thickness is greater than the second thickness.

Clause 95. The article of footwear of any of clauses 1-11 and 94, wherein: the spacer-knit textile comprises a first thickness at a first location at an intersection of a longitudinal midline of the article of footwear and a lateral midline of the article of footwear; the spacer-knit textile comprises a second thickness at a second location that is on the lateral midline and that is closer to a lateral side of the article of footwear than the first location; and the first thickness is greater than the second thickness.

Clause 96. The article of footwear of any of clauses 12-18, wherein the lacing system comprises a plurality of anchors that threadably receive the cable, and wherein the plurality of cable anchors are integrally knit with the upper.

Clause 97. The article of footwear of clause 96, wherein at least some of the plurality of anchors are positioned on a lateral side of the upper.

As used herein, a recitation of "and/or" with respect to two or more elements should be interpreted to mean only one element, or a combination of elements. For example, "element A, element B, and/or element C" may include only element A, only element B, only element C, element A and element B, element A and element C, element B and element C, or elements A, B, and C. In addition, "at least one of element A or element B" may include at least one of element A, at least one of element B, or at least one of element A and at least one of element B. Further, "at least one of element A and element B" may include at least one of element A, at least one of element B, or at least one of element A and at least one of element B.

This detailed description is provided in order to meet statutory requirements. However, this description is not intended to limit the scope of the present disclosure. Rather, the claimed subject matter may be embodied in different ways, to include different steps, different combinations of steps, different elements, and/or different combinations of elements, similar or equivalent to those described in this disclosure, and in conjunction with other present or future technologies. The examples herein are intended in all respects to be illustrative rather than restrictive. In this sense, alternative examples or implementations can become apparent to those of ordinary skill in the art to which the present subject matter pertains without departing from the scope hereof.

We claim:

1. A footwear article, comprising:

an upper at least partially enclosing a foot-receiving cavity;

a sole coupled to the upper, the sole comprising:

a midsole carrier component comprising:

a superior surface facing towards the foot-receiving cavity and comprising a plurality of concave portions, wherein the plurality of concave portions are adjacent to one another across the superior surface;

an inferior surface facing away from the foot-receiving cavity;

a through hole extending from the superior surface to the inferior surface;

an outsole component having a portion positioned adjacent to the superior surface and comprising a traction lug positioned in the through hole and protruding away from the foot-receiving cavity and beyond the inferior surface;

wherein a surface around the traction lug comprises a convex shape that corresponds to one of the plurality of concave portions of the superior surface; and a midsole core component adjacent to the portion of the outsole component and the superior surface, the portion of the outsole component being positioned between the superior surface and the midsole core component.

2. The footwear article of claim 1, further comprising: a cable extending through, and attaching, at least the midsole carrier component and the midsole core component.

3. The footwear article of claim 2, further comprising: a toe cap and a heel counter that are affixed, via the cable, to the midsole carrier component.

4. The footwear article of claim 2, wherein the midsole carrier component comprises:

a first cable-receiving through hole;

a second cable-receiving through hole; and a groove that is in the inferior surface and that connects the first cable-receiving through hole to the second cable-receiving through hole, wherein the cable passes, in the groove, from the first cable-receiving through hole to the second cable-receiving through hole.

5. The footwear article of claim 2, wherein the midsole core component comprises:

a first cable-receiving through hole;

a second cable-receiving through hole;

a second superior surface that faces towards the foot-receiving cavity; and a groove that is in the second superior surface and that connects the first cable-receiving through hole to the second cable-receiving through hole, wherein the cable passes, in the groove, from the first cable-receiving through hole to the second cable-receiving through hole.

6. The footwear article of claim 2, wherein the midsole carrier component and the midsole core component are coupled to one another via the cable and without any chemical adhesive or thermal bonding structure.

7. The footwear article of claim 1, wherein the upper is coupled to the sole via a second cable and without any chemical adhesive or thermal bonding structure.

8. The footwear article of claim 1, wherein:

the through hole comprises a first width; and the traction lug comprises a second width larger than the first width.

9. The footwear article of claim 1, wherein:

the superior surface of the midsole carrier component comprises a recess; and the midsole core component nests in the recess.

10. A method comprising:

positioning an outsole component adjacent to a superior surface of a midsole carrier component, the superior surface of the midsole carrier component comprising a plurality of concave portions, wherein the plurality of concave portions are adjacent to one another across the superior surface, the outsole component comprising a traction lug;

inserting the traction lug through a through hole of the midsole carrier component, wherein the traction lug protrudes beyond an inferior surface of the midsole carrier component; wherein a surface around the traction lug comprises a convex shape that corresponds to one of the plurality of concave portions of the superior surface of the midsole carrier component;

stacking a midsole core component atop the outsole component such that the outsole component is positioned between the midsole carrier component and the midsole core component; and threading a cable through a first set of through holes in the midsole core component and through a second set of through holes in the midsole carrier component.

11. The method of claim 10, further comprising:

positioning the cable in a first groove, which is positioned on a superior surface of the midsole core component and connects a first and a second through hole of the first set of through holes; and positioning the cable in a second groove, which is positioned on an inferior surface of the midsole carrier component and connects a first and a second through hole of the second set of through holes.

12. The method of claim 10, further comprising:

attaching the midsole carrier component to the midsole core component with only the cable and without any chemical adhesive or thermal bonding structure.

13. A footwear article, comprising:

an upper at least partially enclosing a foot-receiving cavity; and a sole coupled to the upper, the sole comprising:

a midsole carrier component comprising a superior surface, wherein the superior surface faces towards the foot-receiving cavity and comprises a plurality of concave portions, wherein the plurality of concave portions are adjacent to one another across the superior surface;

a midsole core component arranged between the superior surface of the midsole carrier component and the foot-receiving cavity; and a cable extending through, and attaching, at least the midsole core component and the midsole carrier component.

14. The footwear article of claim 13, wherein the midsole core component comprises:

a second superior surface that faces towards the foot-receiving cavity;

a groove in the superior surface of the midsole carrier component; and the cable positioned in the groove.

15. The footwear article of claim 13, wherein:

the superior surface of the midsole carrier component comprises a recess; and the midsole core component nests in the recess.

16. The footwear article of claim 13, further comprising a toe cap and a heel counter coupled, via the cable, to the midsole carrier component.

17. The footwear article of claim 16, wherein:

the midsole carrier component and the midsole core component each comprise a foamed material; and the toe cap and the heel counter each comprise a thermoplastic polymer.

18. The footwear article of claim 16, wherein the cable attaches, without an adhesive, the midsole carrier component to the toe cap, the heel counter, and the midsole core component.

19. The footwear article of claim 13, further comprising: an outsole component positioned between the midsole carrier component and the midsole core component.

20. The footwear article of claim 19, wherein the cable secures the midsole carrier component to the outsole component.

* * * * *